US009125509B2

(12) United States Patent
Graneto, III

(10) Patent No.: US 9,125,509 B2
(45) Date of Patent: Sep. 8, 2015

(54) METHODS AND SYSTEMS FOR DEPLOYMENT OF CURTAINS

(75) Inventor: Joseph A. Graneto, III, Wildwood, MO (US)

(73) Assignee: ICP Medical, LLC, St. Louis, MO (US)

( * ) Notice: Subject to any disclaimer, the term of this patent is extended or adjusted under 35 U.S.C. 154(b) by 1384 days.

(21) Appl. No.: 12/274,051

(22) Filed: Nov. 19, 2008

(65) Prior Publication Data

US 2009/0288783 A1 Nov. 26, 2009

Related U.S. Application Data

(63) Continuation-in-part of application No. 12/125,711, filed on May 22, 2008, now abandoned.

(51) Int. Cl.

| | |
|---|---|
| ***A47H 1/00*** | (2006.01) |
| ***A47H 5/14*** | (2006.01) |
| ***A47H 1/04*** | (2006.01) |
| ***A47H 5/032*** | (2006.01) |
| ***A47H 11/02*** | (2006.01) |
| ***A47H 15/02*** | (2006.01) |

(52) U.S. Cl.

CPC .. *A47H 5/14* (2013.01); *A47H 1/04* (2013.01); *A47H 5/032* (2013.01); *A47H 11/02* (2013.01); *A47H 15/02* (2013.01); *A47H 2201/01* (2013.01)

(58) Field of Classification Search

CPC ..... A47H 1/04; A47H 1/02; A47H 2001/04; A47H 2001/0402

USPC ..... 16/87.2, 87.4 R, 95 R, 87 R, 93 D, 95 D; 160/123, 348, 124, 126, 179, 330, 340, 160/341, 345, 347, 332, 382, 383, 385, 388, 160/389, 404; 24/17 B, 298, 716; 248/309.1, 317, 340, 327, 489, 490, 248/498

See application file for complete search history.

(56) References Cited

U.S. PATENT DOCUMENTS

| | | | | |
|---|---|---|---|---|
| 2,280,697 | A | | 4/1942 | Gaines |
| 2,320,308 | A | * | 5/1943 | Silverman ..... 16/87.2 |
| 2,884,055 | A | | 4/1959 | Truesdale |
| 3,105,543 | A | * | 10/1963 | Nolan ..... 160/346 |
| 3,137,027 | A | | 6/1964 | Birkle |
| 3,585,674 | A | | 6/1971 | Golden |
| 3,616,486 | A | | 11/1971 | Ford et al. |
| 3,638,711 | A | | 2/1972 | Mazzarelle |
| 3,779,539 | A | | 12/1973 | Ziers |
| 4,141,105 | A | | 2/1979 | Gonon |
| 4,282,630 | A | | 8/1981 | Toder |
| 4,285,095 | A | | 8/1981 | Janson |

(Continued)

OTHER PUBLICATIONS

International Search Report and Written Opinion of PCT/US09/40489; Feb. 3, 2010; 26 pages.

*Primary Examiner* — Katherine Mitchell
*Assistant Examiner* — Jeremy Ramsey
(74) *Attorney, Agent, or Firm* — Luedeka Neely Group, P.C.

(57) ABSTRACT

A curtain system is described that includes a curtain having a plurality of rod engaging members attached at an end thereof. The plurality of rods each have a curtain release mechanism attached thereto where the rod engaging members are configured to engage respective curtain release mechanisms. The curtain release mechanisms each include a user operable mechanism for retention of and subsequent substantially simultaneous release of the rod engaging members from the curtain release mechanisms.

28 Claims, 20 Drawing Sheets

(56) References Cited

U.S. PATENT DOCUMENTS

| | | | | | |
|---|---|---|---|---|---|
| 4,525,893 | A | | 7/1985 | Fukada | |
| 4,675,939 | A | | 6/1987 | Fukada | |
| 4,688,620 | A | | 8/1987 | Lechner et al. | |
| 4,793,399 | A | * | 12/1988 | Pryor | 160/345 |
| 4,796,684 | A | | 1/1989 | Haimovitz | |
| 5,217,057 | A | | 6/1993 | Hubbard et al. | |
| 5,282,292 | A | | 2/1994 | Levy | |
| 5,291,632 | A | | 3/1994 | Akashi | |
| 5,385,373 | A | * | 1/1995 | Love | 292/307 B |
| D359,410 | S | | 6/1995 | Domel et al. | |
| 5,421,551 | A | | 6/1995 | LeClaire | |
| 5,518,058 | A | | 5/1996 | Gastmann | |
| 5,544,387 | A | | 8/1996 | Yamamoto et al. | |
| 5,544,393 | A | | 8/1996 | Lightfoot | |
| 5,615,461 | A | | 4/1997 | Tominaga et al. | |
| 5,794,461 | A | | 8/1998 | Smith | |
| 5,894,642 | A | | 4/1999 | Eberhardt | |
| 5,903,957 | A | | 5/1999 | Le Manchec | |
| D425,747 | S | | 5/2000 | Sloan | |
| 6,189,597 | B1 | | 2/2001 | Cheng | |
| 6,192,965 | B1 | | 2/2001 | Hinds | |
| 6,382,297 | B1 | | 5/2002 | Takizawa et al. | |
| 6,394,168 | B1 | | 5/2002 | Zoboski | |
| 6,564,851 | B1 | | 5/2003 | Liao | |
| D482,223 | S | | 11/2003 | Bibby et al. | |
| D523,675 | S | | 6/2006 | Schorling | |
| 7,350,244 | B1 | | 4/2008 | Handley | |
| 8,151,385 | B2 | | 4/2012 | Goskowski et al. | |
| 2003/0102091 | A1 | * | 6/2003 | Liao | 160/330 |
| 2004/0074613 | A1 | | 4/2004 | Junger et al. | |
| 2006/0266483 | A1 | | 11/2006 | Roberts et al. | |
| 2007/0261803 | A1 | | 11/2007 | Alexander et al. | |
| 2008/0041538 | A1 | | 2/2008 | Granger | |
| 2011/0283479 | A1 | * | 11/2011 | Peters et al. | 16/87.2 |

* cited by examiner

METHODS AND SYSTEMS FOR DEPLOYMENT OF CURTAINS

CROSS REFERENCE TO RELATED APPLICATIONS

This application is a continuation-in-part application of co-pending application Ser. No. 12/125,711 filed May 22, 2008, now abandoned which is hereby incorporated by reference in its entirety.

BACKGROUND OF THE INVENTION

This invention relates generally to curtains, and more specifically, to methods and systems for deployment of curtains.

Curtains, and more specifically disposable or washable curtains, have long been used, in hospitals for example, to provide privacy, room division, and to a lesser extent, to cover storage areas. Generally, these curtains are suspended from a track on a ceiling for operation. For example, the curtains can be operated to substantially surround a patient's bed for privacy, and retracted at other times when privacy is not an issue.

Most of these curtains have two portions, namely, an upper mesh component and a lower opaque component. The upper mesh component is typically above eye level so the privacy function is not compromised. This mesh component is not necessarily required, however, the opaque portion cannot extend to the ceiling. Generally, the opaque portion cannot extend to the ceiling because if it did, it is possible that it would interfere with ceiling mounted sprinklers in the event of a fire because the water from the sprinklers cannot easily pass through the opaque material. Other reasons that mesh portions are generally incorporated are that they ensure that the opaque portion of the curtain does not interfere with lighting and/or air circulation.

In the hospital application, the curtains become soiled and can collect one or more of bacteria, molds, and viruses (collectively contaminants) during use. This can be a source of cross-contamination, for example, from one patient to one or more of another patient, a health care provider or other staff, and a visitor to the hospital. Unfortunately, hospital curtains are also typically difficult to change and/or wash. Generally, if the curtain is provided in a single, combined mesh portion/opaque portion embodiment, someone has to gain access to the ceiling level of the room to change the curtain. This is difficult, labor intensive, and generally requires that a ladder of some type be used.

There are some known two piece curtains. Generally, the opaque portion is separated from the mesh portion and a new opaque portion is attached to the existing mesh portion. While this may address the need for a ladder, it is still labor intensive and does not address the possibility that the mesh portion retains one or more of the above described contaminants. With respect to the labor required for replacement, the person making the replacement with this type of curtain has to make a plurality of attachments between the opaque and mesh portions while holding the replacement opaque portion of the curtain, or has to operate a zipper or similar device that extends the entire length of the curtain. At least one of the problems with this type of arrangement is that the mesh portion or similar mechanism is generally not in a fixed position, adding to the difficulty of curtain replacement.

BRIEF DESCRIPTION OF THE INVENTION

In one aspect, a curtain system is provided that includes a curtain having a plurality of rod engaging members attached at an end thereof. The plurality of rods each have a curtain release mechanism attached thereto where the rod engaging members are configured to engage respective curtain release mechanisms. The curtain release mechanisms each include a user operable mechanism for retention of and subsequent substantially simultaneous release of the rod engaging members from the curtain release mechanisms.

In another aspect, a curtain is provided that includes a curtain body and a plurality of rod engaging members attached to the curtain body. The rod engaging members each include a stem having a first end and a second end, a release mechanism engaging member extending from the first end of the stem, a first curtain engaging piece extending from the second end of the stem, and a second curtain engaging piece configured for snap fit engagement with the first curtain engaging piece with a portion of the curtain therebetween.

In still another aspect, a curtain system is provided that includes a curtain having a plurality of rod engaging members attached thereto, a plurality of rods, and a ceiling track engaging component that is configured for engagement with an attachment device. The plurality of rods each includes an elongated central member comprising a first end and a second end, the attachment device attached to the first end, and a curtain release mechanism attached to the second end. The rod engaging members are configured to engage respective curtain release mechanisms. The curtain release mechanism includes a user operable mechanism for retention of and subsequent substantially simultaneous release of the rod engaging members from the curtain release mechanisms.

In yet another embodiment, a curtain suspension system is provided. The curtain suspension system includes a plurality of rods each having a first end and a second end, a curtain release mechanism attached at the first end of each of the rods, a ceiling track engaging component at the second end of each of the rods, and a linkage extending across the plurality of rods and attached to the rods proximate the second end. The linkage is operable, when the rods are proximate one another, to help maintain an alignment between adjacent rods such that the curtain release mechanisms are aligned for ease in inserting a key therethrough.

DETAILED DESCRIPTION OF THE INVENTION

Figure 1:
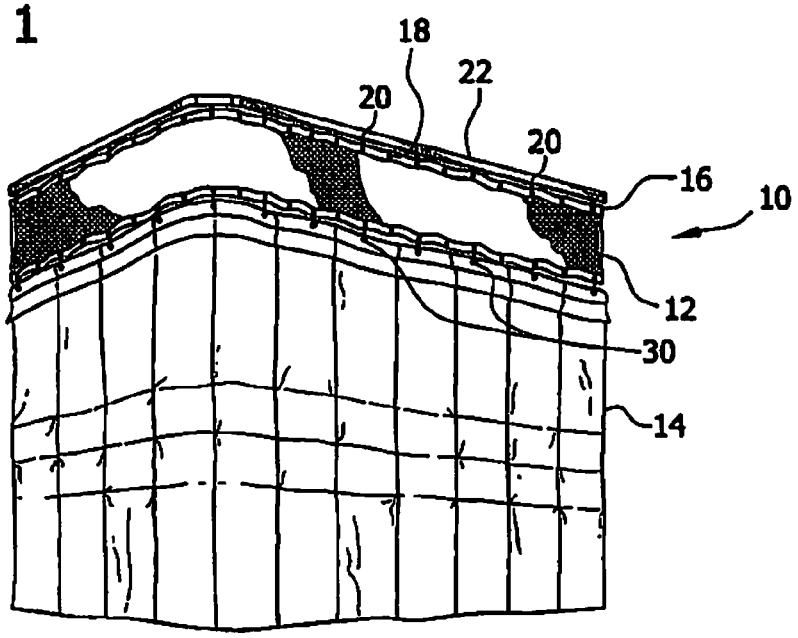
FIG. 1 Prior Art
FIG. 1 is an illustration of a known privacy curtain system.

FIG. 1 is a perspective view of a known privacy curtain 10. Curtain 10 includes an upper mesh portion 12 and a lower opaque portion 14 that is suspended from the upper mesh portion 12. The lower opaque portion 14 is removable from the upper mesh portion 12. As described above, the upper mesh portion is constructed in part from a mesh material to allow for lighting, air circulation, and the operation of fire sprinklers. The lower opaque portion is constructed from an opaque material to provide privacy when the curtain 10 is in an extended position. The curtain 10 is suspended from a track 20 attached to a ceiling 22 as is well known. In this example, the upper mesh portion 12 of curtain 10 and the lower opaque portion 14 include a series of mating fasteners 30. The mating fasteners 30 are provided to removably suspend the lower opaque portion 14 from the upper mesh portion 12. The upper mesh portion 12 is configured with reinforced holes 18 which are engaged by hooks (not shown) hanging from track 20.

As discussed above, conventional privacy curtains tend to become soiled and are prone to contamination with one or more bacteria, mold, and viruses. To address this issue, the lower opaque portion 14 may be disposable, and can be changed as often as necessary to address the issues noted above. Since the lower opaque portion 14 provides the privacy function, the upper mesh portion 12 is suspended near the ceiling and is, therefore, not in a position where it is less likely to present the cross-contamination risk associated with the lower opaque portion 14. Therefore, the upper mesh portion 12 need not be changed nearly as frequently as the lower opaque portion 14.

While the configuration of FIG. 1 addresses many known problems, some still exist. One, it cannot be assured that the upper mesh portion 12 is free from the contamination described above. Two, while the fasteners 30 may be at a comfortable work level, it is still difficult for personnel to attach a replacement lower opaque portion 14 to the upper mesh portion 12. This difficulty is due to the fact that the area of upper mesh portion 12 where the fasteners 30 are located is prone to movement as it is distant from the engagement of the upper mesh portion 12 with the track 20.

At least one other privacy curtain system incorporates a series of rods between the ceiling and the curtain. This system provides the lighting and fire sprinkler considerations mentioned above, while still addressing the contamination issue. Examples of these systems are shown in FIG. 2.

Figure 2:
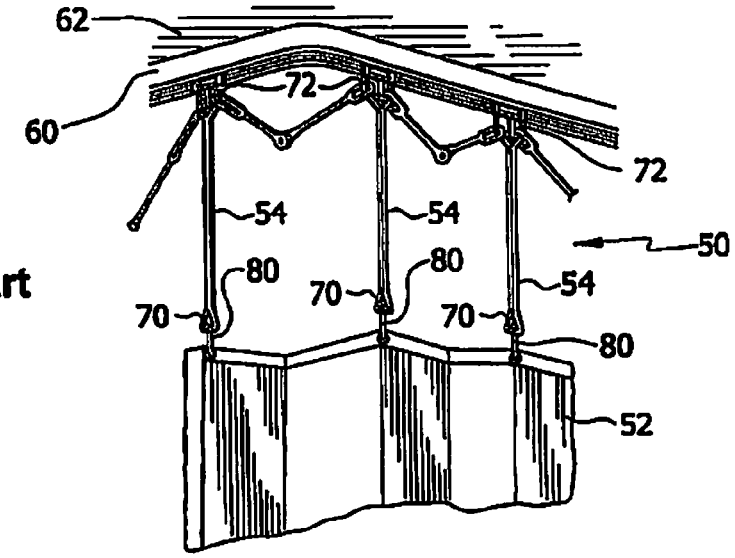
FIG. 2 Prior Art
FIG. 2 is an illustration of a hanger assembly from which a privacy curtain is suspended.

Referring to FIG. 2, a hanger assembly 50 is illustrated that is configured for the suspending of a curtain 52 similar to the lower opaque portion 14 shown in FIG. 1. A plurality of rods 54 extend down from a track 60 that is attached to a ceiling 62. While the assembly of FIG. 2 has several features, one feature that is common with the curtain system of FIG. 1 is that a lower end 70 of the rods 54 is relatively free to move with respect to a user, as it can essentially pivot about its upper end 72. In addition, the rods 54, especially at the lower end 70 are free to move with respect to each other. This freedom of movement causes difficulty for the person removing an old curtain 52 and installing a new curtain 52 at the lower end.

Another issue with the system of FIG. 2 is that curtain 52 has to be removed from each rod 54 individually, and a new curtain 52 has to be attached to each rod 54 individually as individual hooks 80, engaged with the lower end 70 of rods 54 are utilized to attach curtain 52 to rods 54. Generally, when a person replaces one of curtains 10 and 52, they have to gather up the curtain in their arms to control the bulk of the curtain while they detach the curtain from the rod or upper mesh portion. While it may never be possible to completely eliminate personnel contact with soiled and/or contaminated curtains, it is possible to reduce the amount of contact between the two as further explained herein.

The following descriptions, and accompanying figures, are related to embodiments that address some of the issues described above with respect to the removal of old curtains, and the subsequent attachment of new curtains.

Figure 3:
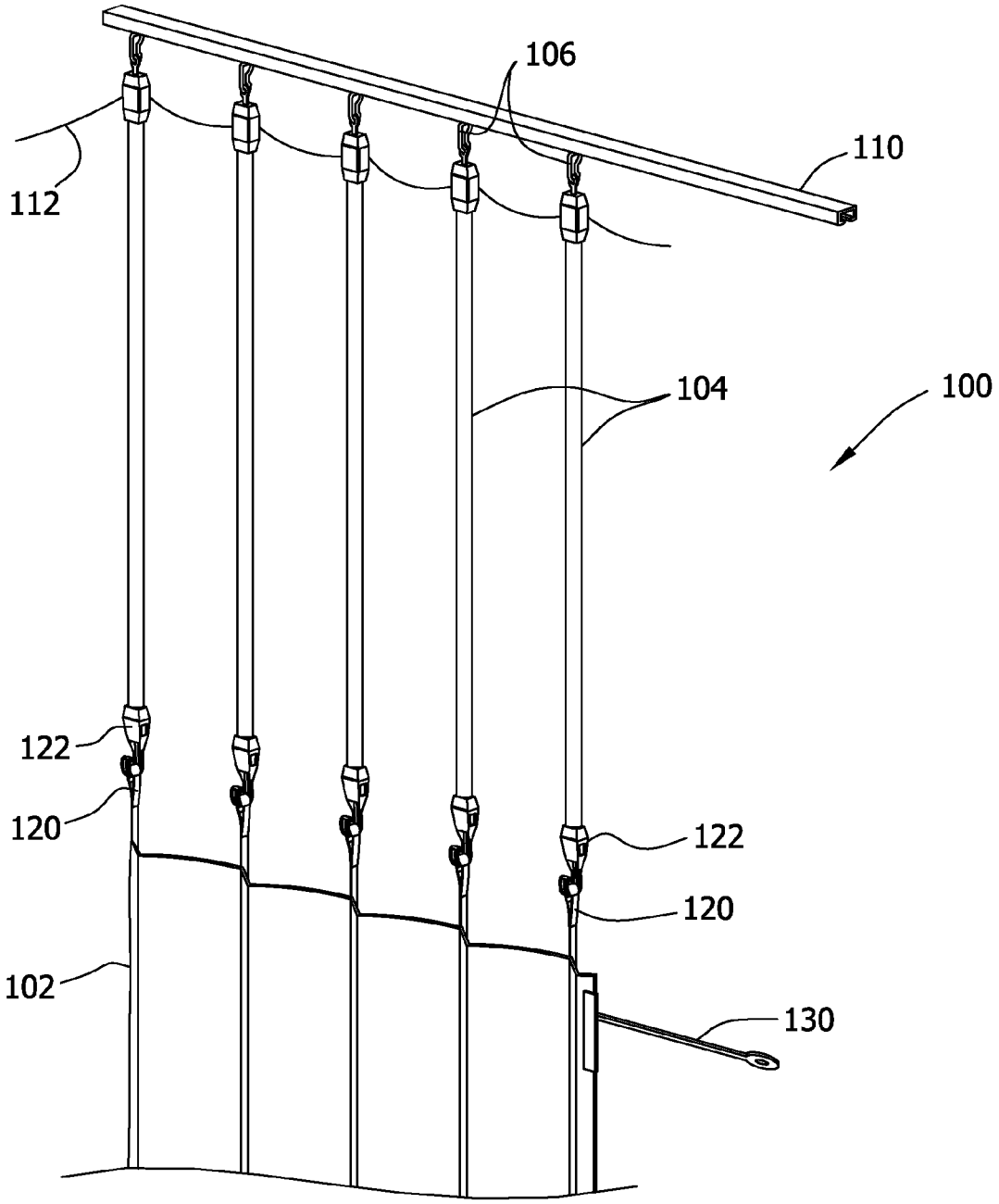
FIG. 3 is an illustration of one embodiment of a curtain system that incorporates a gathering cord for removal of the curtain from a plurality of rods.

More specifically, FIG. 3 is an illustration of one embodiment of a curtain system 100. Curtain system 100 includes a curtain 102, and a plurality of rods 104 that extend from tracked hooks 106 which are located within a track 110 of the type that is attached to a ceiling (not shown). The tracked hooks 106 are capable of lateral movement within the track 110 for the purpose of opening and closing the curtain 102. When the curtain 102 is open, the rods 104 are in a position substantially adjacent one another, as further addressed below. This position may also be referred to as having the curtain 102 in a gathered position. When the curtain 102 is closed the rods 104 are moved from the substantially adjacent position to a configuration where they are substantially spread out along the length of the track 110. This position may also be referred to as having the curtain 102 in a deployed position. In one embodiment, a binding cord 112 extends between the rods 104 and is secured to each of the rods 104. As it is secured to each of the rods 104, binding cord 112 operates to dictate a maximum distance between the individual rods 104. As addressed in detail below, rod engaging members 120 are secured within the curtain 102 and are configured to engage a lower end 122 of the rods 104. The engagement between a rod engaging member 120 and a respective lower end 122 may be any type of mechanical configuration, several of which are described below.

In the illustrated embodiment, the curtain 102 is also configured with a curtain gathering cord 130. While curtain gathering cord 130 may be operative to gather the curtain 102, as further illustrated in the following figures, curtain gathering cord 130 is further operative to release the curtain 102 from the rods 104. In the illustrated embodiment, and in other embodiments described hereafter, the curtains are fabricated from either a disposable material or a material that may be reused after a cleaning process.

Figure 4A:
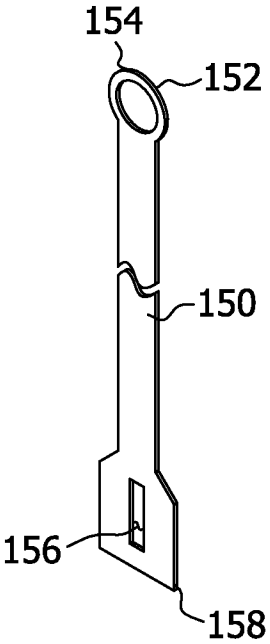
FIGS. 4A-4D illustrate a rod engaging member utilized to attach a curtain to a rod suspended from a ceiling track, along with operation of the rod engaging members.
Figure 4B:
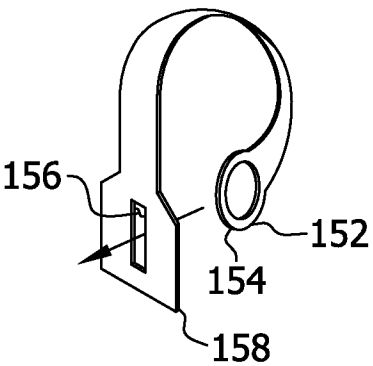
Figure 4C:
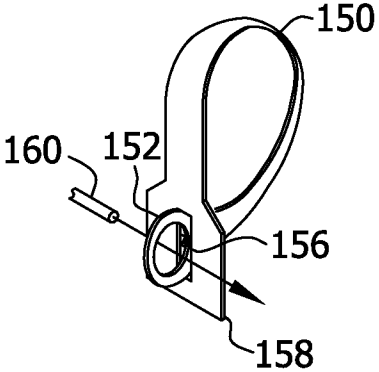
Figure 4D:
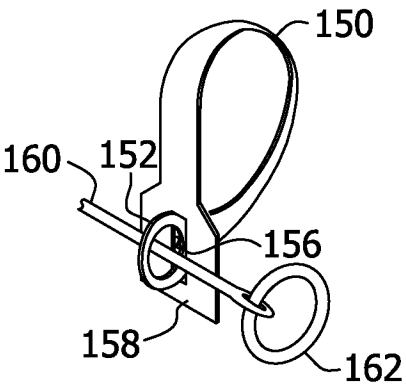

FIGS. 4A through 4D illustrate one embodiment of a rod engaging member 150 that can be utilized with a curtain of the type described with respect to FIG. 3. The embodiment of rod engaging member 150 shown in FIGS. 4A-4D may sometimes be referred to as a looped ribbon. As illustrated in FIG. 4A, the rod engaging member 150 is elongated and has a loop 152 formed in a first end 154, and a slot 156 therethrough formed near a second end 158. The rod engaging member 150 is fabricated from a material, and the loop 152 is sized so that when the rod engaging member 150 is bent into a substantially circular configuration, at least a portion of the first end 154 containing the loop 152 will pass through the slot 156 formed near the second end 158. As shown in FIG. 4C, once a portion of the loop 152 is extending through slot 156, a gathering cord 160 can be passed through the loop 152, retaining a position of the loop 152 with respect to the slot 156. A completed configuration shown in FIG. 4D as the engagement of the first end 154 with the second end 158 forms a hoop which can engage a rod as further described with respect to FIG. 5. As further described, gathering cord 160 can be grasped and pulled by a user such that the cord is no longer within the loop 152, the loop is then free to move away from the slot 156. When a plurality of such rod engaging members 150 are deployed with a curtain, removal of the gathering cord 160 from the rod engaging members 150 will operate to release the curtain from the apparatus from which it hung. This operation is described in further detail herein. An optional end ring 162 may be attached to the gathering cord 160 to allow a user to more easily pull the gathering cord 160 through, and from, a curtain. As shown in subsequent figures, and as mentioned above, operation of the gathering cord 160 allows a user to easily remove a curtain from a plurality of the rods 104 described above with respect to FIG. 3.

Figure 5:
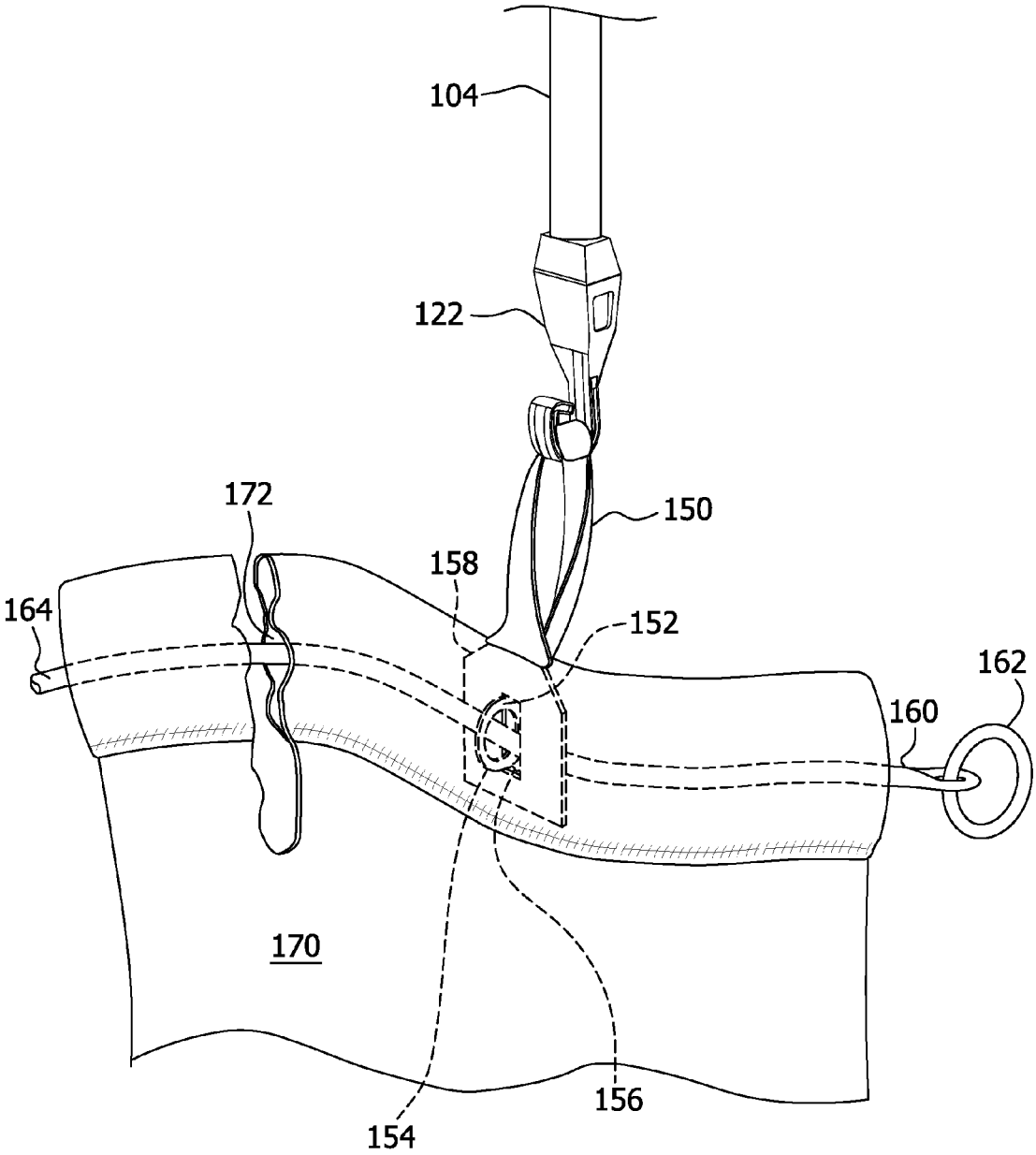
FIG. 5 illustrates operation of the ribbon loop and the binding cord with respect to the attachment of a curtain to a rod.

FIG. 5 illustrates one of the rod engaging members 150 (ribbon loops) from FIG. 4, where the second end 158 is attached to a curtain 170. The first end 154 passes through slot 156 and a least a portion of the surface of the curtain 170. Gathering cord 160 is secured within a channel 172 formed in the curtain material that is formed during the fabrication process associated with curtain 170. The fabrication process may include attaching the second ends 158 of the rod engaging members 150 to the curtain material through, for example, a stitching process or through a heat activated attachment process. The channel 172 may be formed through the stitching process, the heat treatment process or through another process. In any event, when the curtain fabrication process is complete, the gathering cord 160 is slidably engaged with the curtain 170 and the gathering cord 160 passes through the loops 152 of the rod engaging members 150 to form the ribbon loops as shown in FIG. 4D. Such a configuration allows the curtain 170 to be hung from a plurality of rods 104. After the utilization of curtain 170 is complete, and as can be seen in FIG. 5, when the gathering cord 160 is pulled from engagement with the curtain 170, loop 152 will release from slot 156, and gravity will cause the curtain 170 and attached rod engaging members 150 to fall away from the lower ends 122 of a plurality of rods 104. In one embodiment, the gathering cord 160 may include a second end 164 that is utilized for gathering the curtain 170 when the gathering cord is operated. In one embodiment, the second end 164 is simply attached to the curtain material during the curtain fabrication process to enable this operation. This attachment is easily overcome to enable the removal of curtain 170 from the rods 104 as described.

Figure 6:
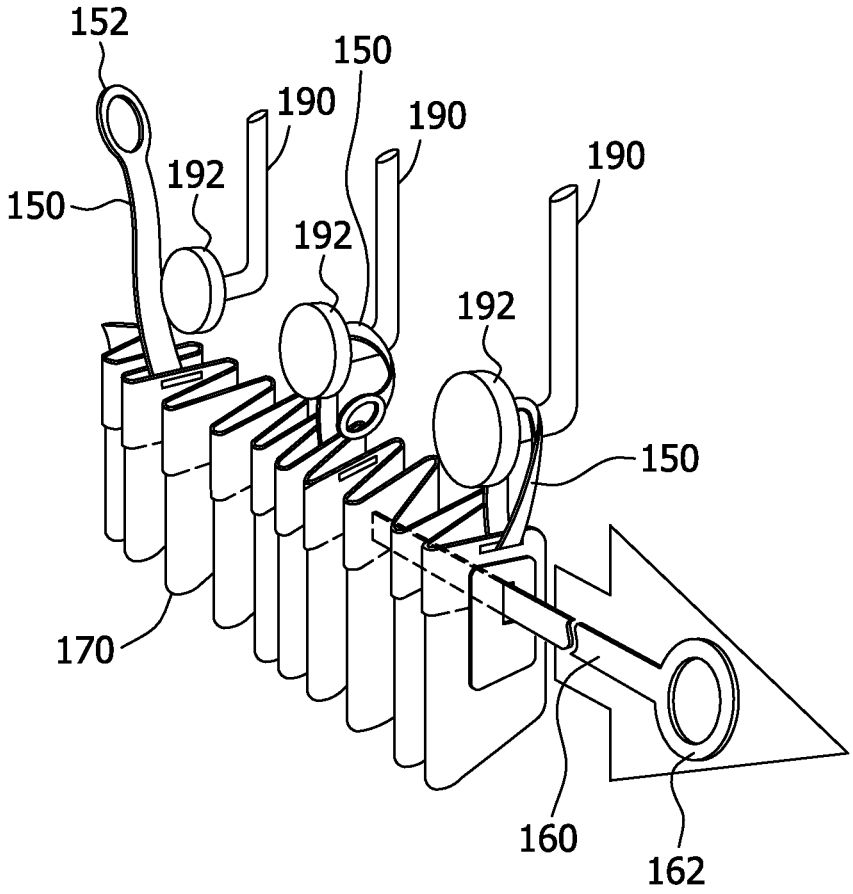
FIG. 6 illustrates utilization of the gathering cord to release a curtain from a plurality of rods through operation of a plurality of rod engaging members.

FIG. 6 provides further illustration utilizing an alternative embodiment of rod 190 and rod lower end 192. In FIG. 6, pulling the end ring 162 of gathering cord 160 causes the curtain 170 to gather. Pulling further on the end ring 162, and thus gathering cord 160, causes the rod engaging members 150 to release the curtain 170 from the rods 190 as shown. The release from the curtain 170 happens as the gathering cord 160 is removed from engagement with the individual rod engaging members 150, causing the separation of loop 152 and slot 156 as shown in FIGS. 4A-4D and FIG. 5. The benefit of such a configuration is that the curtain 170 is gathered and all of the interfaces between curtain 170 and rods 190 are released relatively close to simultaneously, and the curtain 170 can fall onto the floor or into a container. In one contemplated embodiment, packaging for the replacement curtain 170 includes a container for the disposal of the curtain 170 that is being replaced. The person changing the curtain does not have to personally gather and hold the curtain 170 and therefore their exposure to germs and the like is thought to be reduced as they, at most, have to carefully remove the curtain 170 being replaced from the floor, rather then essentially hugging the entire curtain 170 as is currently done when removing a curtain 170.

In a practical application, the curtain 170 is provided in packaging that is operable to expose the rod engaging members 150 such that they can be engaged with the rods 190 prior to the exposure of a remainder of the curtain 170 from the packaging. In one embodiment, the curtain 170 is sterilized and the packaging maintains the sterilization until it is opened.

Figure 7:
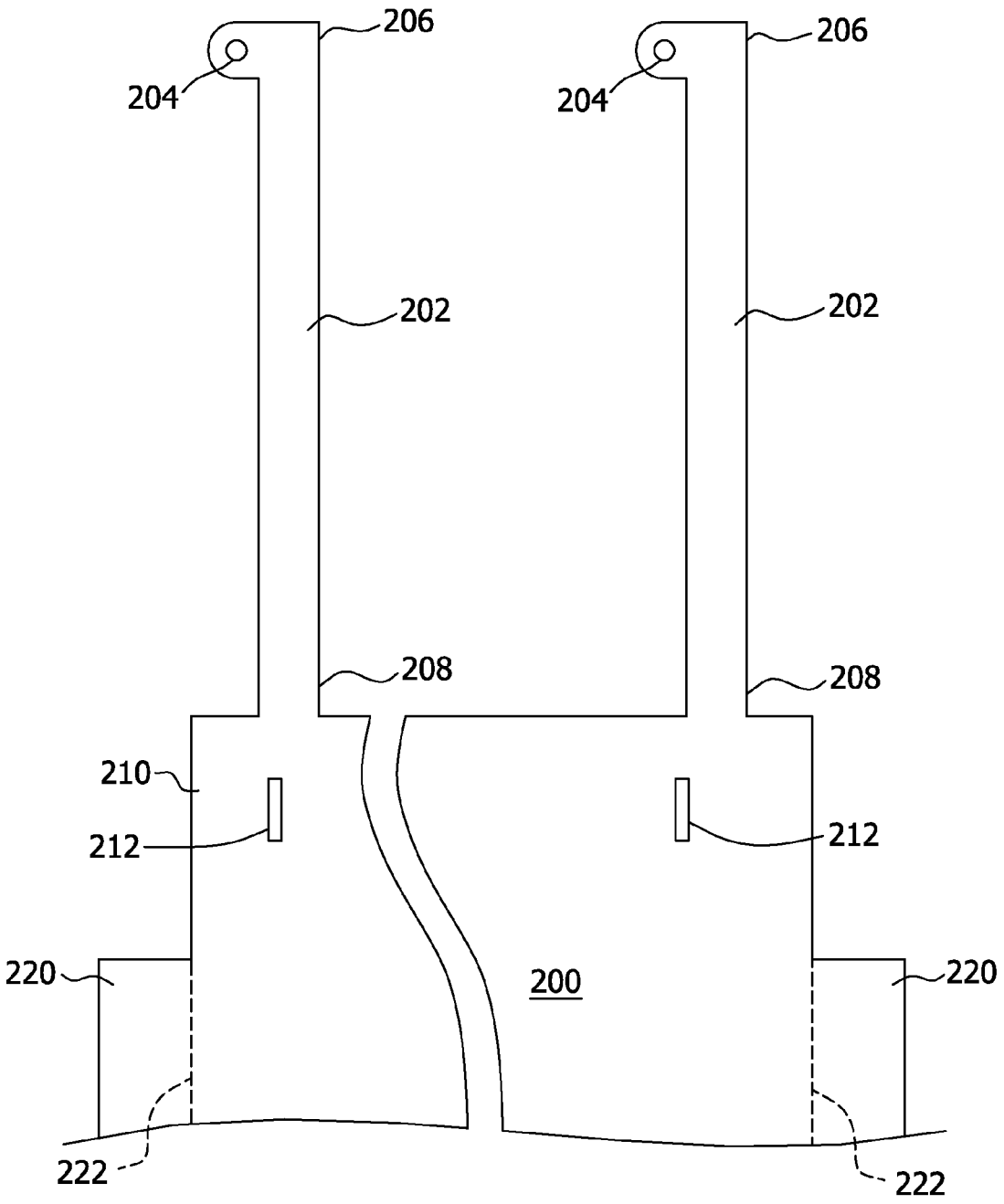
FIG. 7 is a schematic view of a curtain that incorporates integrally formed rod engaging members.

FIG. 7 is an illustration of an alternative embodiment of a curtain 200 which incorporates integrally formed rod engaging members 202 in a one-piece configuration. In such a configuration, material is cut away from the curtain 200 in the fabrication process to form the rod engaging members 202. One example of such a fabrication process is a die cutting process. Rod engaging members 202 are elongated and each has a loop 204 formed in a first end 206, and a second end 208 that adjacent to the main portion 210 of the curtain 200. As curtains 200 and rod engaging members 202 are in a one-piece configuration, the rod engaging members 202 are fabricated from the same material as the remainder of the curtain 200. The first end 206, which includes loop 204, is sized so that when the rod engaging member 202 is bent into a substantially circular configuration, at least a portion of the first end 206 containing the loop 204 will pass through a slot 212, formed in the main portion 210 of the curtain, near an intersection with the second end 208. As illustrated, curtain 200 includes two end portions 220, which are folded over and attached to the main portion 210 of the curtain 200 to provide reinforcement for the sides 222 of the curtain 200.

Like the above described embodiment, curtain 200 may be utilized with a gathering cord (not shown) that can be passed through the loop 204, retaining a position of the loop 204 with respect to the slot 212. In a practical application, the curtain 200 is provided in packaging that is operable to expose the rod engaging members 202 such that they can be engaged with the rods 104 prior to the exposure of a remainder of said curtain.

Figure 9:
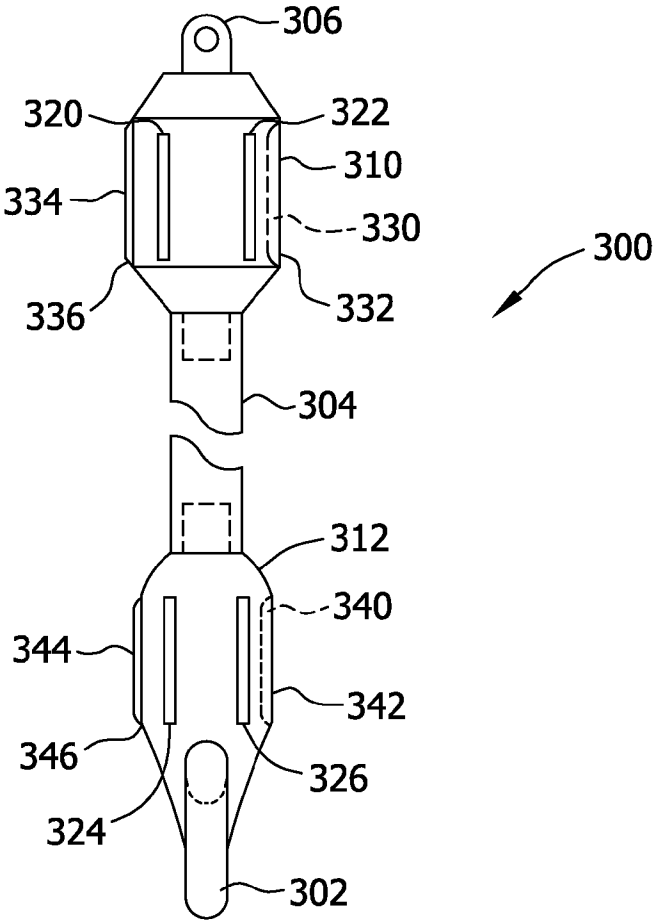
FIG. 9 is a front view of the rod of FIG. 8.
Figure 8:
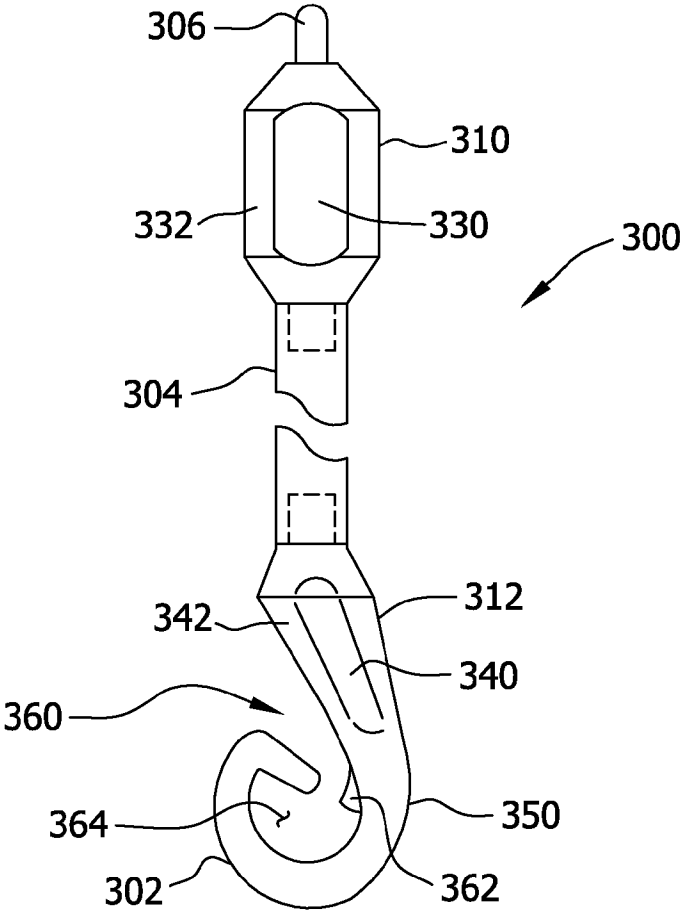
FIG. 8 is a side view of one embodiment of a rod that may be utilized to hang a curtain from a ceiling mounted track system.

FIGS. 8 and 9 illustrate one embodiment of a rod 300 that may be utilized to hang the curtains 170 and 200 (shown in FIGS. 6 and 7 respectively) from a ceiling mounted track system. Specifically, rod 300 includes a lower hooking member 302 for engaging the rod engaging members 150 and 202, and elongated central member 304, and an upper track engagement member 306 that is utilized to attach the rod 300 to a ceiling mounted tracking system of the type previously described herein. The elongated central member 304 extends between the upper track engagement member 306 and the lower hooking member 302.

Rod 300 is configured to address the problems present in known curtain attachment systems by incorporating mechanisms that retain multiple rods in a substantially adjacent orientation for the removal of old curtains and attachment of new curtains. Specifically, and in the illustrated embodiment, an upper nestable member 310 is included between the upper track engagement member 306 and the elongated central member 304 and a lower nestable member 312 is included between the lower hooking member 302 and the elongated central member 304.

In one embodiment, both the upper nestable member 310 and the lower nestable member 312 incorporate a series of magnets 320, 322, 324, and 326 encased therein. The upper nestable member 310 is formed to include both a side wall indentation 330 in a first side wall 332 and a side wall protrusion 334 in a second side wall 336 that is opposite the first side wall 332. Likewise, the lower nestable member 312 is formed to include both a side wall indentation 340 in a first side wall 342 and a side wall protrusion 344 in a second side wall 346 that is opposite the first side wall 342. The configurations of the upper nestable member 310 and the lower nestable member 312 may be different that the embodiment illustrated in FIGS. 8 and 9, but all are common in that they each incorporate at least one magnet that is oriented such that it helps to maintain multiple rods 300 in a position substantially adjacent one another when changing a curtain.

In addition, multiple configurations are possible for side wall protrusions and indentations. The configurations are common in that they provide simple keyed surfaces and a non-binding shape to help maintain the substantial adjacent positioning, and make the encased magnets that much more effective for maintaining the described substantially adjacent positioning for the rods 300.

A specific embodiment for lower hooking member 302 is illustrated in FIG. 8. Specifically, a curtain engaging portion 350 of lower hooking member 302 is configured with a cross-section that is somewhat J-shaped. Extending from the side walls 342 and 346 is a semi-circular member 352 which terminates in a curtain retention member 354 that extends from the semi-circular member 352 at substantially a right angle. The result is a slot 360 formed between the curtain retention member 354 and the remainder of the lower hooking member 302. The rod engaging members associated with a curtain are passed through slot 360 for attachment of a curtain to the rods 300. In one embodiment, a barb 362 protrudes from the curtain engaging portion 350 towards the curtain retention member 354 further narrowing slot 360. Slot 360 opens to an enlarged opening 364 within which the rod engaging members are deployed upon passing through slot 360. The resulting configuration is such that a rod engaging member easily passes through slot 360 since the rod engaging member is fabricated from a flexible material. However, the barb 362 and the curtain retention member 354 are shaped such that slot 360 gradually narrows until such point as the slot 360 interfaces with the enlarged opening 364. This configuration operates to reduce a likelihood of a rod engaging member of a curtain from passing back through slot 360 from the enlarged opening 364.

Figure 10:
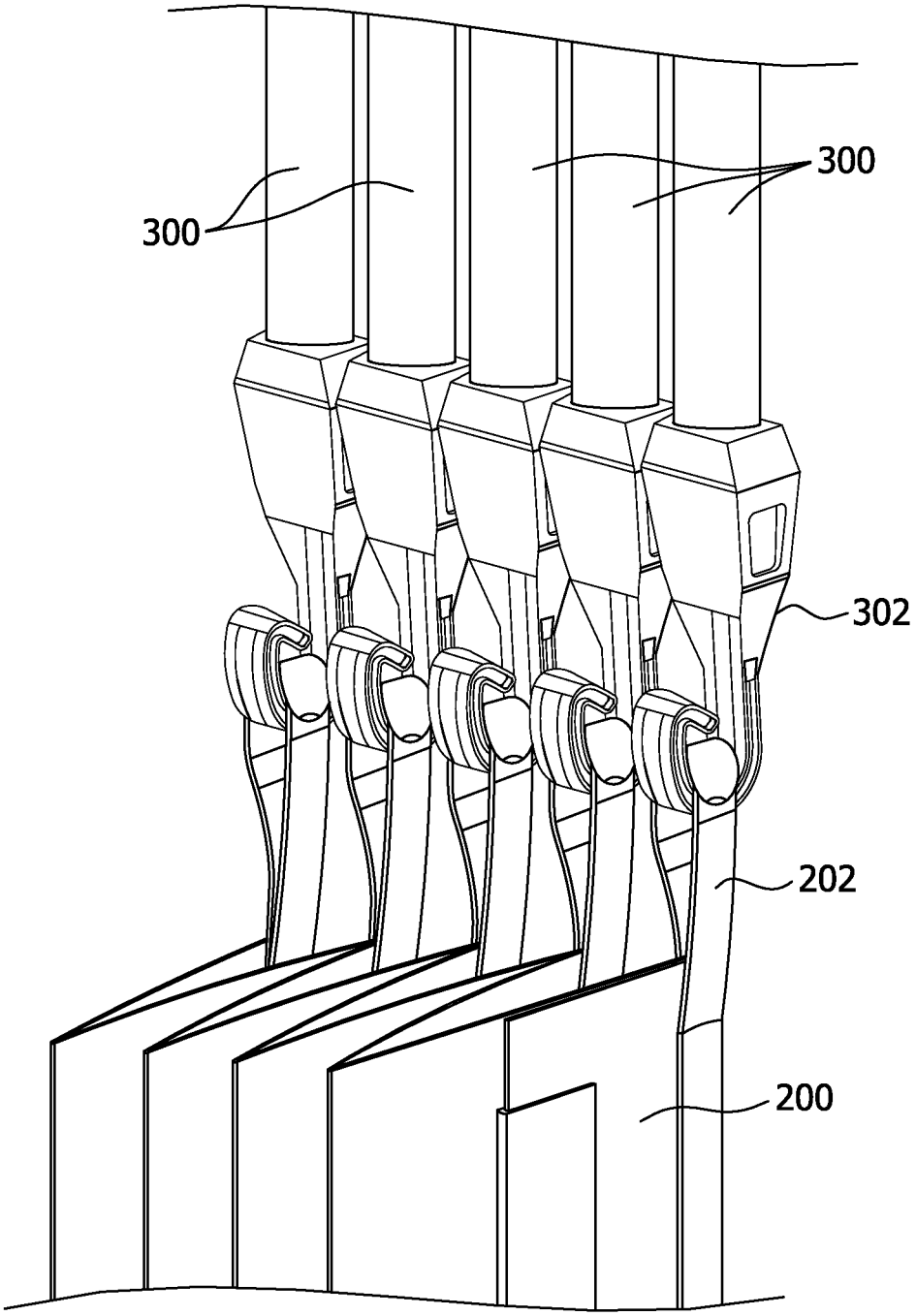
FIG. 10 is a perspective view of several of the rods described with respect to FIGS. 8 and 9 in a substantially adjacent position.

FIG. 10 is a perspective view of several rods 300 in the substantially adjacent position. Each of the rods 300 incorporates the features described with respect to FIGS. 8 and 9. In one aspect, curtain 200 operates to dictate a maximum distance between any two rods 300 when they are separated from one another. In other words, when a user provides a force that overcomes the force provided by the encased magnets, such as would be applied by a user to deploy a curtain, the curtain 200 operates to constrain how far apart the rods may be positioned.

More importantly, however, incorporation of the various magnet embodiments described with respect to FIG. 9 within the rods 300 provide a much needed help to a user when installing a new curtain. Specifically, and as shown in FIG. 10, by maintaining the plurality of rods 300 substantially adjacent to one another, it is much easier for the user to place the individual rod engaging members (rod engaging members 202 are shown in FIG. 10) onto the lower hooking members 302 of the rods 300. The ease is provided because the rods are not free to pivot with respect to one another and slide along a track with respect to one another as they are in certain known curtain configurations.

Figure 11:
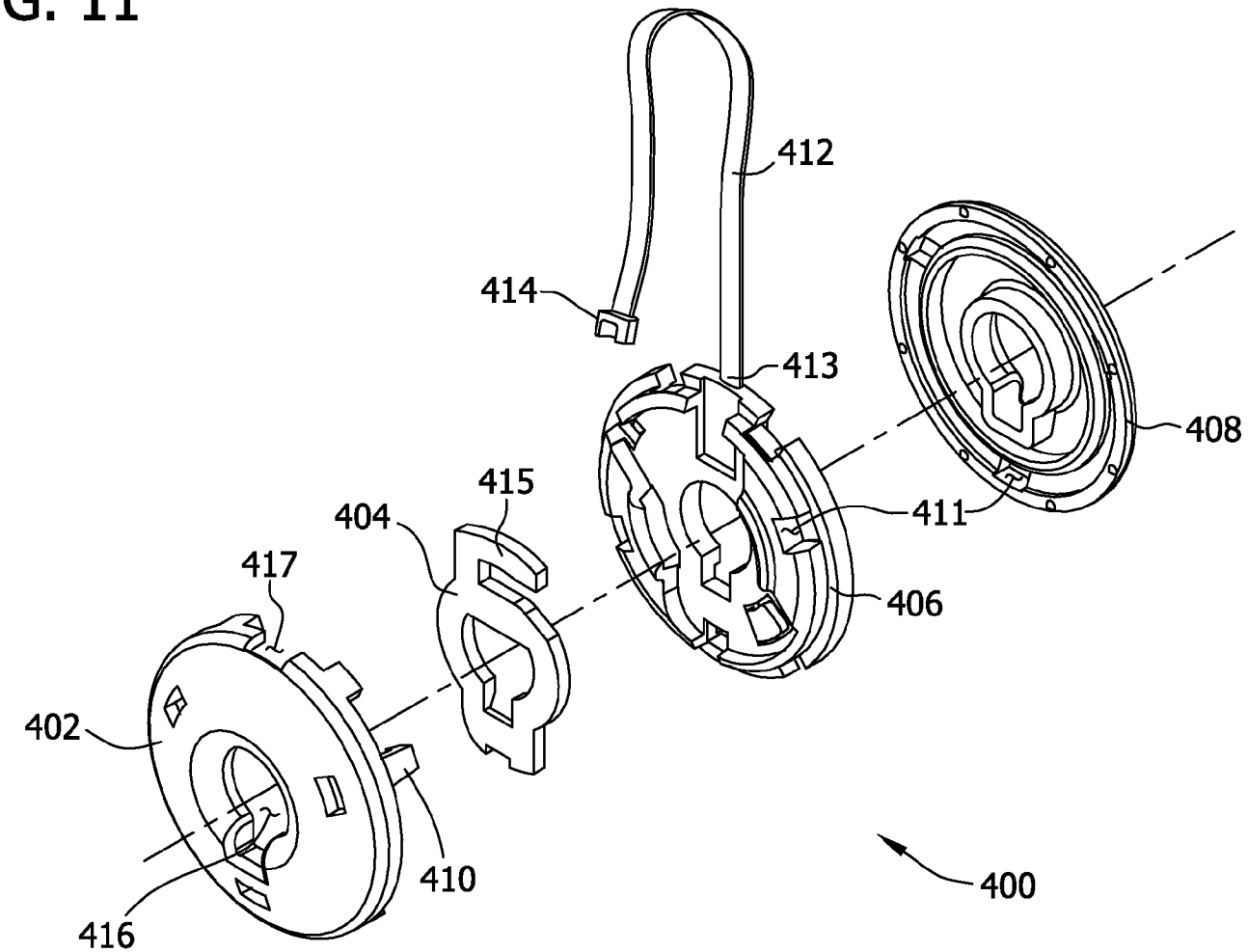
FIG. 11 is an exploded view of a curtain release mechanism.

FIG. 11 is an exploded view of an embodiment of a curtain release mechanism 400 for a curtain system. The curtain release mechanism 400 includes a front cover 402, a tumbler 404, an eye front 406, and a back cover 408. Tumbler 404 is configured to nest rotatably within eye front 406. Front cover 402 includes protrusions 410 that are configured to pass through holes 411 in both eye front 406 and back cover 408. The protrusions 410 are configured to engage the holes 411 formed in back cover 408 by a snap-fit configuration after passing through back cover 408, to fabricate the curtain release mechanism 400, with tumbler 404 still free to rotate with respect to the eye front 406.

Eye front 406 includes a rod engaging member in the form of a strap 412 extending therefrom which is used for hanging the curtain. Strap 412 includes a first end 413 attached to eye front 406 and a second end to which is attached a release mechanism engaging member 414. When the curtain release mechanism 400 is assembled, a gap 417 is formed between the front cover 402 and eye front 406. The release mechanism engaging member 414 and a portion of strap 412 pass through the gap 417 such that the release mechanism engaging member 414 can be secured to tumbler 404 by a notch 415 formed therein. As further described below, when tumbler 404 is rotated, a position of notch 415 is changed thereby releasing the release mechanism engaging member 414 from the curtain release mechanism 400. In alternative embodiments, the first end 413 of strap 412 is attached to the back cover 408 or front cover 402 instead of the eye front 406.

A key aperture 416 is formed when the front cover 402, tumbler 404, eye front 406, and back cover 408 are properly assembled. The key aperture 416 is formed by holes through the center of the front cover 402, tumbler 404, eye front 406, and back cover 408. The hole through the tumbler 404 is shaped differently than the holes in the front cover 402, eye front 406, and back cover 408. Because of the differently shaped hole in the tumbler 404, the curtain release device 400 is configured such that when a key (described below) is inserted and rotated in key aperture 416, only tumbler 404 is rotated, while the front cover 402, eye front 406, and back cover 408 do not rotate, enabling the retention and release of release mechanism engaging member 414, and therefore strap 412, described above.

Figure 12A:
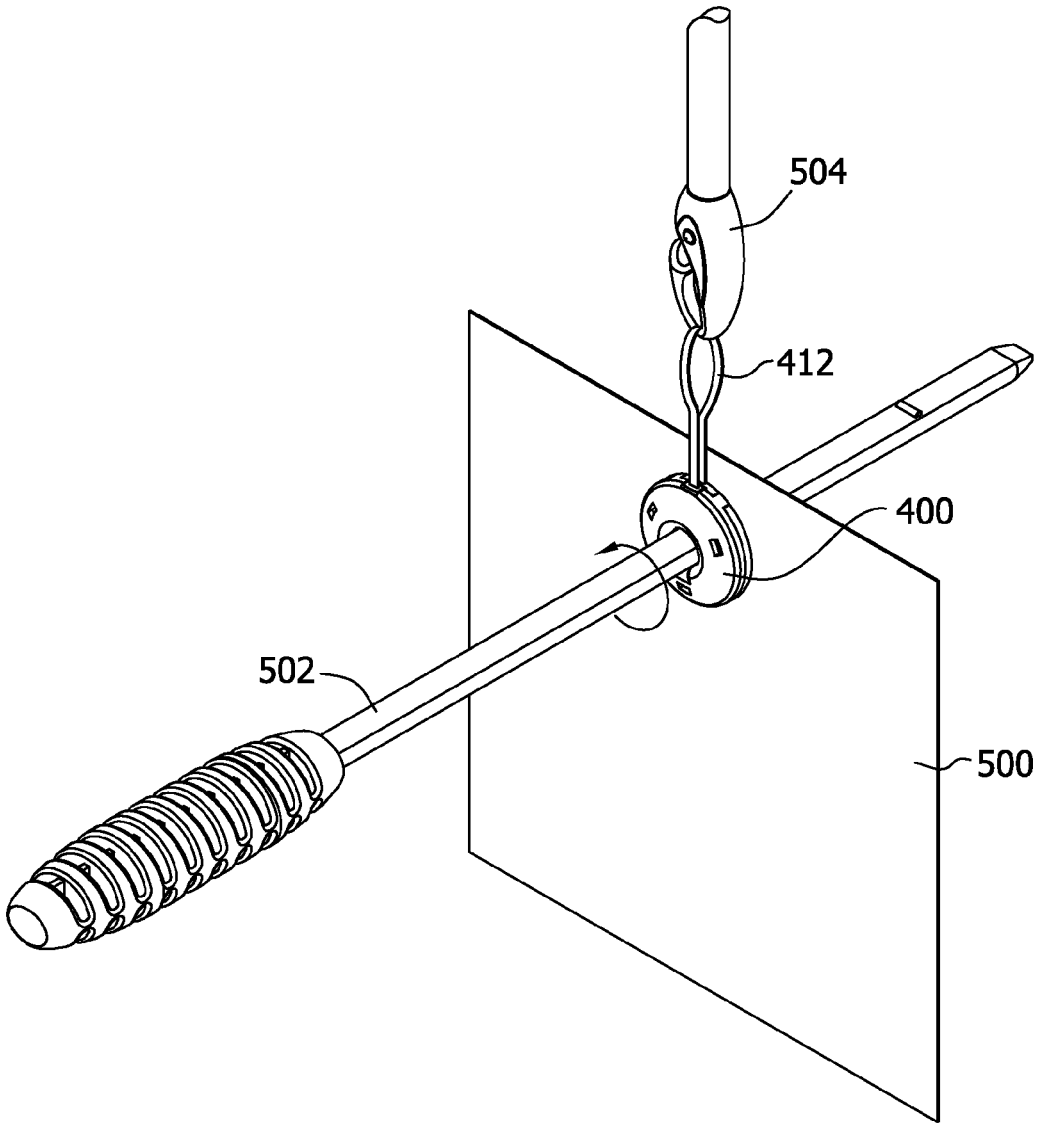
FIGS. 12A and 12B are perspective views of a curtain using a key and the curtain release mechanism of FIG. 11.
Figure 12B:
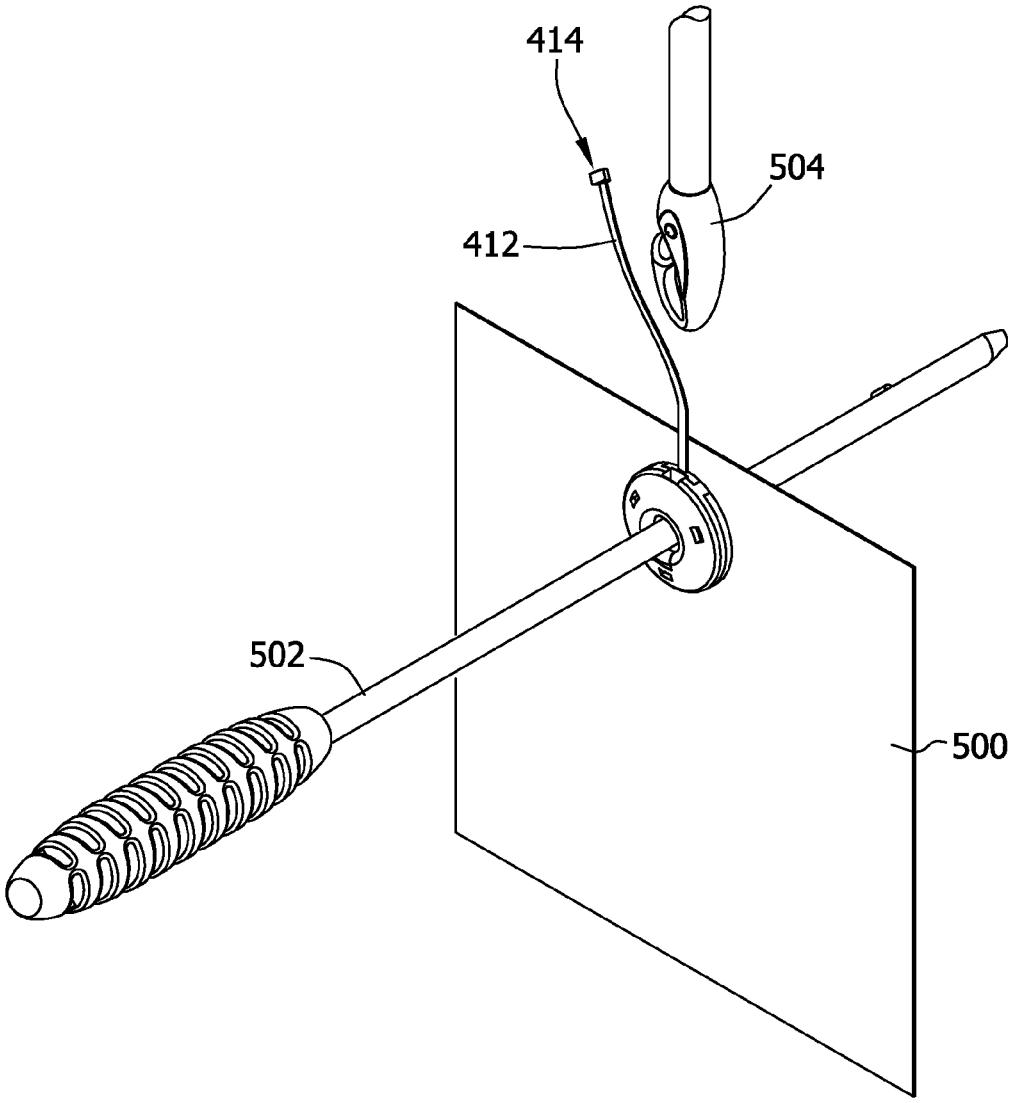

FIGS. 12A and 12B demonstrate the use of a key 502 to release a curtain 500 from a hook 504, when the curtain 500 incorporates the curtain release mechanism 400. The curtain release mechanism 400 may be attached to the curtain material through, for example, a mechanical attachment process. In one embodiment, the curtain 500 is positioned between eye front 406 and back cover 408 when the curtain release mechanism 400 is assembled. When the curtain 500 is hanging from hook 504, as shown in FIG. 12A, it is the strap 412 that is engaged by hook 504. To release the strap 412 from the hook 504, key 502 is inserted into the key aperture 416 of the curtain release mechanism 400 (shown in FIG. 11). Then, as shown in FIG. 12B, key 502 is rotated about its axis to rotate the tumbler 404 and cause release of the release mechanism engaging member 414 from the notch 415 in the tumbler 404. After release mechanism engaging member 414 is released, curtain 500 is free to fall from hook 504, due to the disengagement of strap 412 from hook 504.

Figure 13:
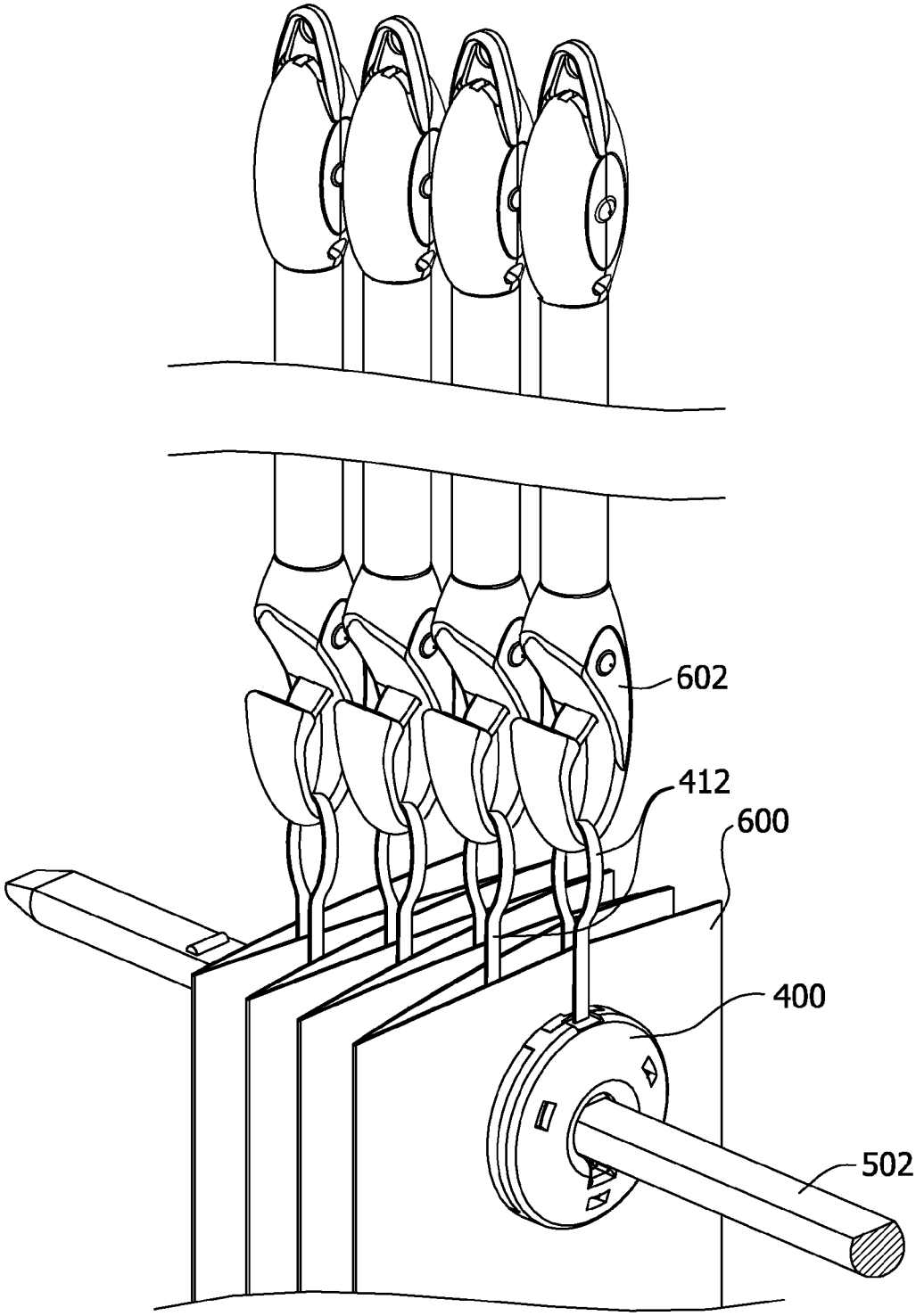
FIG. 13 is a perspective view of several curtain portions that each include a curtain release mechanism and are folded together in preparation of being released by a key.

FIG. 13 is an illustration of a curtain 600 that incorporates multiple curtain release mechanisms 400. In operation, and similar to embodiments described above, sections of curtain 600 are able to be bunched together and simultaneously released via the operations described above. In the illustrated embodiment, the curtain 600 is gathered and key 502 is inserted through all the curtain release mechanisms 400 attached to the curtain 600. Turning of the key releases the individual release mechanism engaging members 414 substantially simultaneously. The result is that all straps 412 are free to disengage from hooks 602. The benefit of such a configuration is that the curtain 600 is gathered and all of the interfaces between the curtain sections and hooks 602 are released relatively simultaneously, and the curtain 600 can fall onto the floor or into a container.

Figure 14:
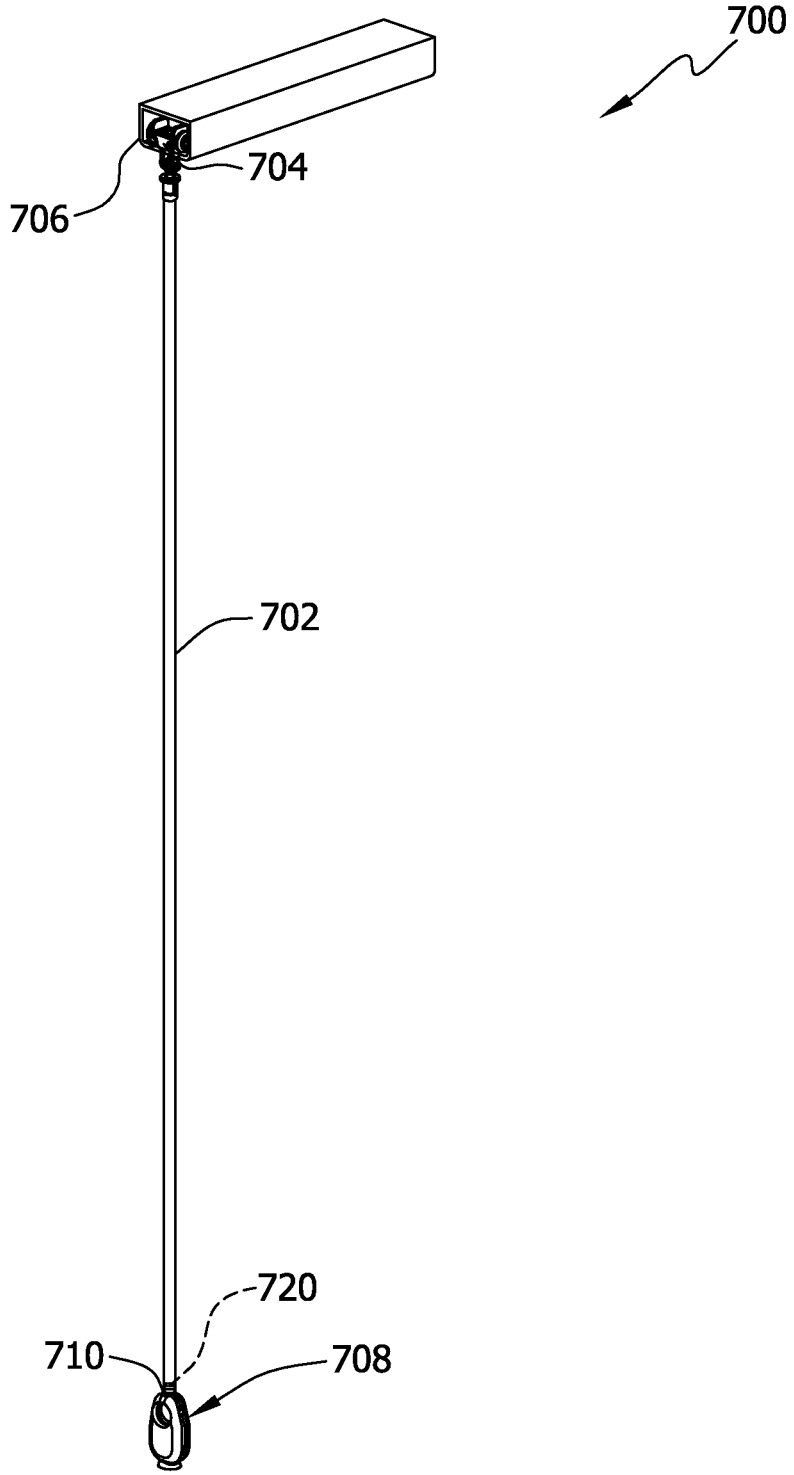
FIG. 14 is a perspective view of an alternative embodiment of a hanger assembly from which a curtain can be suspended.

FIG. 14 is a perspective view of an alternative embodiment of a hanger assembly 700 from which a curtain can be suspended. Hanger assembly 700 may also sometimes be referred to as a curtain suspension system. Hanger assembly 700 includes a curtain rod 702, a ceiling track engaging component 704 configured for engagement with a first end 706 of rod 702, and a curtain release mechanism 708 configured for engagement with a second end 710 of rod 702. As will be explained with respect to the following figures, hangar assembly 700 differs from the assemblies described above in that a key is inserted through the curtain release mechanisms 708 to release a curtain rather than through a rod engaging member as in the embodiments described above. As is easily understood, to form an operable hanger assembly 700, a plurality of rods 702 and associated components are utilized. To that end, in one embodiment rods 702 are hollow and may include one or magnets 720 disposed near the bottom 722 thereof. As is described further, the presence of these magnets 720 is helpful in maintaining a substantially adjacent and parallel orientation for a plurality of rods 702 when a curtain is being removed from the rods 702 and associated curtain release mechanisms 708 or installed onto same.

Figure 15:
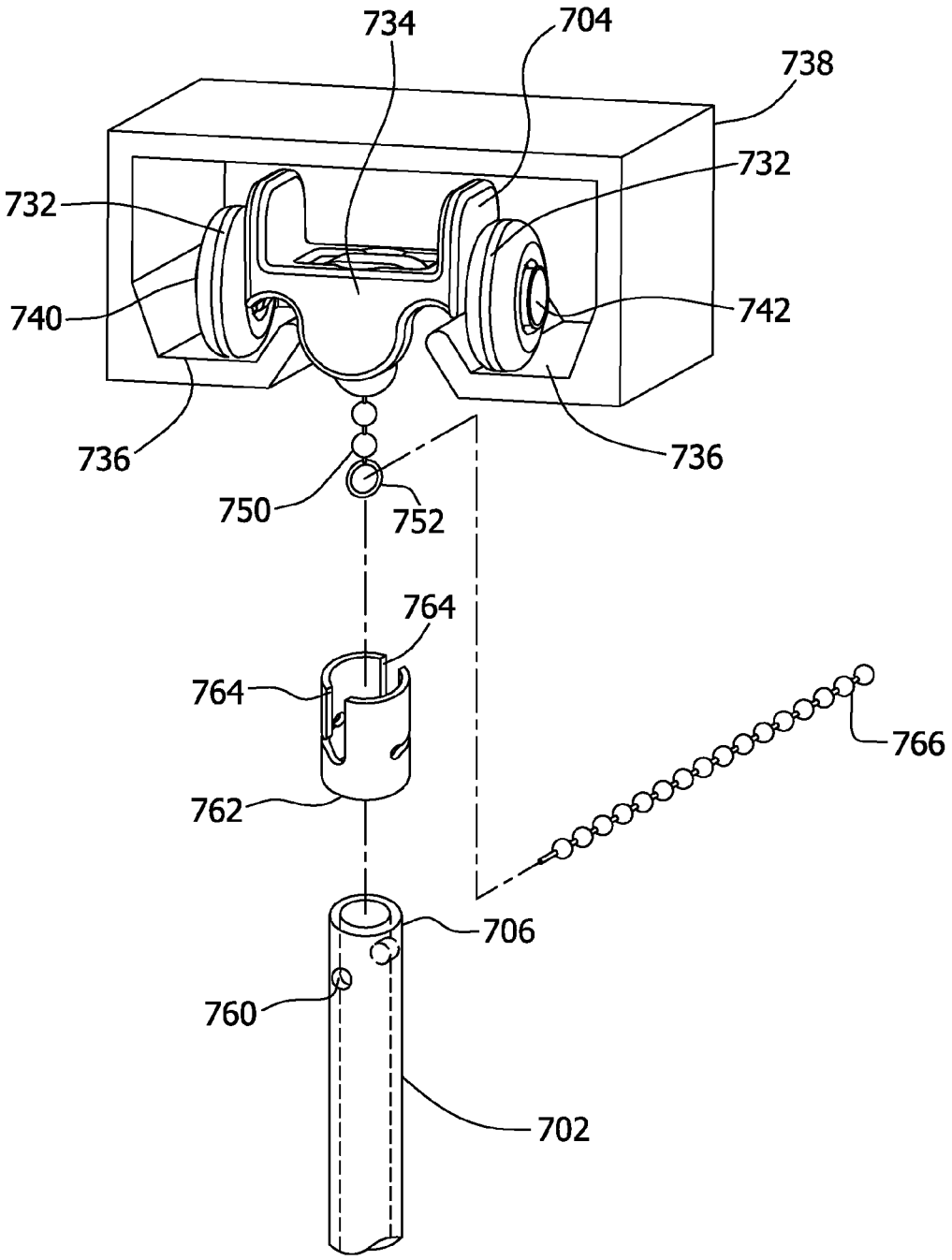
FIG. 15 is an illustration of a ceiling track engaging component having a curtain rod extending therefrom.

FIG. 15 is an illustration of a ceiling track engaging component 704 having a curtain rod 702 extending therefrom as mentioned above. As shown in FIG. 15, ceiling track engaging component 704 includes at least two rollers 732 that extend from an engaging component body 734 and engage (roll along) respective channels 736 within a ceiling track component 738. Rollers 732 are rotatable with respect to their attachment to engaging component body 734 to allow ceiling track engaging component 704 to move along the channels 736 of the ceiling track component 738. In the illustrated embodiment, axles 740 and 742 extend from the engaging component body 734 and are configured such that rollers 732 can attach thereto in a snap fit arrangement while still being rotatable with respect to the engaging component body 734.

Extending from engaging component body 734 such that it is positioned between the channels 736 is a rod suspending chain 750 that is attached to the engaging component body 734. At the bottom of chain 750 is a loop 752. As is well understood, loop 752 is rotatable with respect to the remainder of chain 750 and engaging component body 734. As shown in the figure, rod 702 includes two slots 760 formed therein that extend downward from the first end 706 of the rod 702. A sleeve 762 includes two matching slots 764 which extend for a distance in a vertical direction, then for an additional distance in the horizontal direction. Slots 764 are essentially configured so that a second chain 766 (sometimes referred to herein as a linkage) can be passed through the loop 752 and into the slots 760. To complete this subassembly, the sleeve 762 further engages the second chain 766 and the first end 706 of the rod 702. The sleeve 762 is maneuvered so that the chain 766 engages the vertical portion of the slots 764. The sleeve 762 can then be rotated so that the second chain 766 is positioned within the horizontal portion of the slots 764. The effect is a locking of the chain 766 in a particular position with respect to rod 702. Benefits of utilizing chain 766 are presented below. In operation, a user moving rod 702 effectively rolls ceiling track engaging component 704 along the channels 736 of the ceiling track component 738. At certain times, a curtain is attached to the rod as discussed extensively herein.

Figure 16:
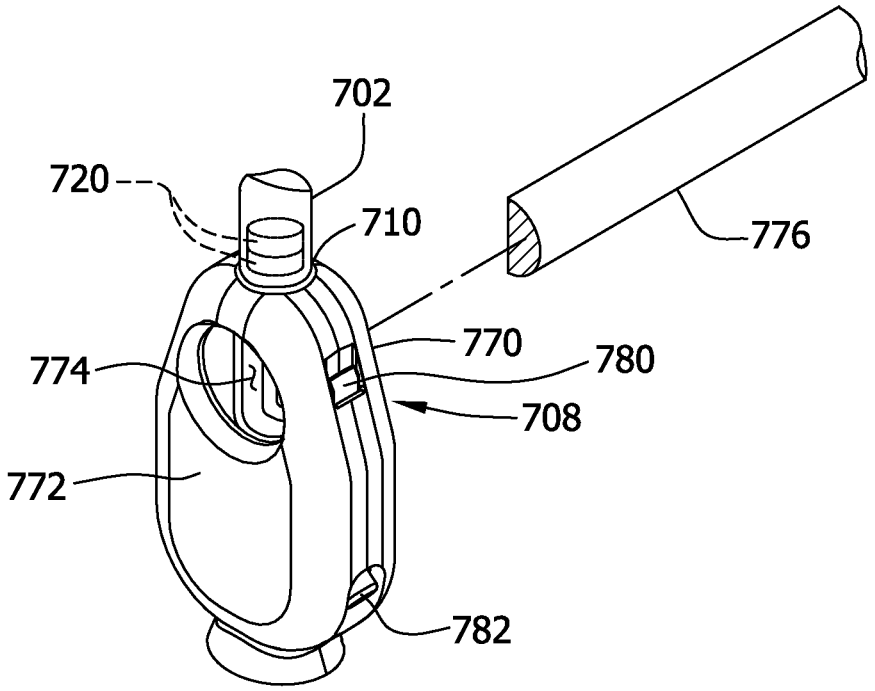
FIG. 16 is a side view of a curtain release mechanism attached to the rod illustrated in FIG. 14.

FIG. 16 is a perspective view of the curtain release mechanism 708 attached to the second end 710 of rod 702. Curtain release mechanism 708 includes a first body half 770 and a second body half 772 that engage one another in a snap fit arrangement to house a rotatable tumbler 774. A key 776 is utilized to rotate tumbler 774 to release a rod engaging member 800 (shown in FIG. 17). In the illustrated embodiment, and as further described below, curtain release mechanism 708 includes two indicators that work somewhat in tandem. A tumbler position indicator 780 and a locking mechanism indicator 782 are shown in the illustrated embodiment and are further described below.

Figure 17:
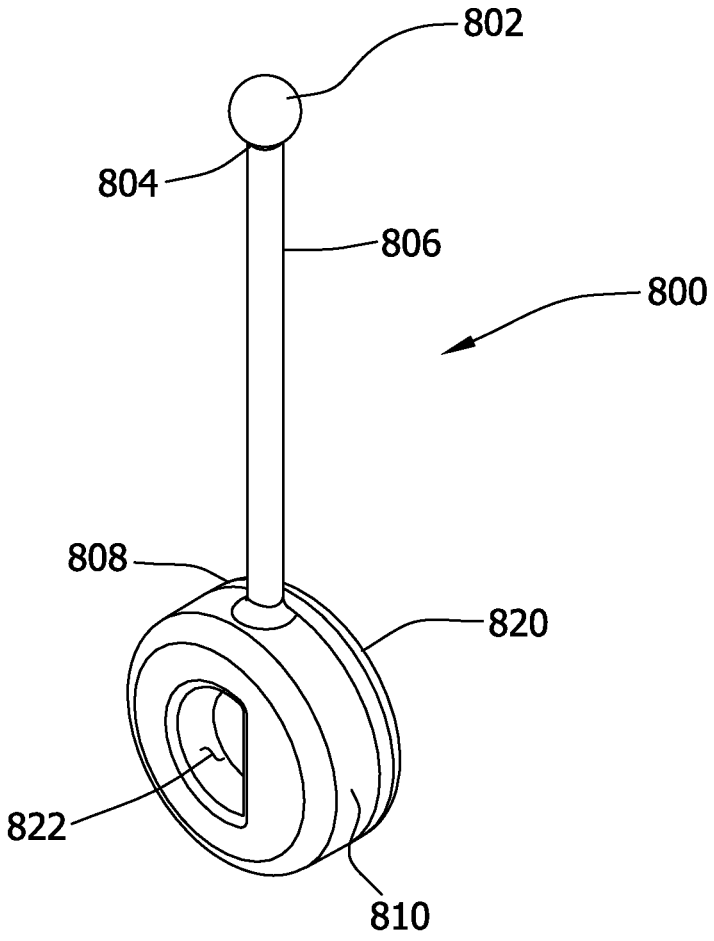
FIG. 17 is a side view of an alternative embodiment of a rod engaging member engaging the curtain release mechanism of FIG. 16.

FIG. 17 is a side view of an alternative embodiment of a rod engaging member 800 configured to engage the curtain release mechanism 708 of FIG. 16. Rod engaging member 800 includes a release mechanism engaging member 802 extending from a first end 804 of a stem 806 which also has a second end 808 that is attached to a first curtain engaging piece 810. In one embodiment, release mechanism engaging member 802, stem 806, and first curtain engaging piece 810 are formed as a single item from injection molded plastic. In the illustrated embodiment, release mechanism engaging member 802 is substantially spherical, but other shapes are contemplated as long as the rotatable tumbler of the curtain release mechanism 708 is configured to engage such a shape. A second curtain engaging piece 820 is configured for snap fit engagement with first curtain engaging piece 810 with a portion of a curtain therebetween. The first curtain engaging piece 810 and the second curtain engaging piece 812 are both configured with a keyway 822 therethrough such that when press fit together, the key 776 (shown in FIG. 16) may extend therethrough.

Generally, a curtain (not shown in FIG. 17) is fabricated to include a plurality of the described rod engaging members 800. A user may insert the key 776 through the multiple keyways 822 of a bundled curtain to provide support when installing the multiple rod engaging members 800 into the corresponding curtain release mechanisms 708 (shown in FIG. 16).

Figure 18:
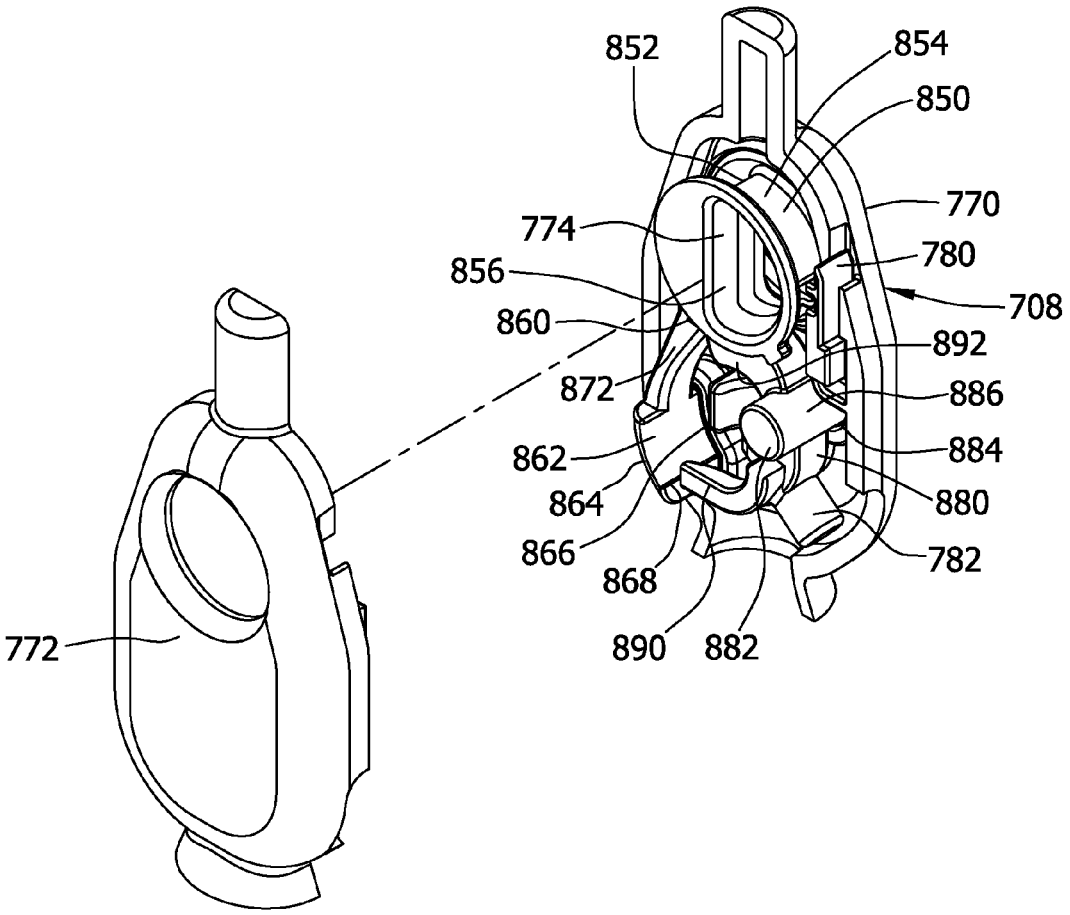
FIG. 18 is an exploded view of the curtain release mechanism of FIG. 16.

FIG. 18 is an exploded view of the curtain release mechanism 708 of FIG. 16 which illustrates in further detail the above mentioned rotatable tumbler 774. The rotatable tumbler 774 as described above includes a keyed member 850 that is configured for rotation between the first body half 770 and the second body half 772 of the curtain release mechanism 708. The rotatable tumbler 774 includes the lock state indicator 780 described above. The keyed member 850 includes a flat surface 852 on the outside diameter 854 of the keyed portion 856 that engages a first end 860 of a flexible latch 862 that is held in place between the first body half 770 and the second body half 772 by laterally extending tabs 864 and 866 proximate a second end 868 of the flexible latch 862. The flexible latch includes a tang (not shown) proximate a mid-section 872 of the flexible latch 862.

A pivoting member 880 is also held in place between the first body half 770 and the second body half 772 by laterally extending posts 882 and 884 proximate a mid-section 886 of the pivoting member 880. A forked end 890 of the pivoting member 880 is configured to engage the release mechanism engaging member 802 and a tang engaging member 892 is configured to engage the tang in the flexible latch 862. The locking mechanism indicator 782 extends through a window formed in the first body half 770 and the second body half 772.

When the keyed member 850 is turned, the flat surface 852 changes position, causing the flexible latch 862 to flex, thereby releasing the tang from the tang engaging member 892. This release allows the pivoting member 880 to pivot so that the release mechanism engaging member 802 can fall away from the forked end 890 of the pivoting member 880, releasing the curtain. When a release mechanism engaging member 802 and corresponding stem 806 are then inserted into the curtain release mechanism 708, the release mechanism engaging member 802 will push against the tang engaging member 892 so that the pivoting member 880 pivots into a position where the tang engaging member 892 reengages the tang. This reengagement also causes the position of the forked end 890 to move to a position such that the release mechanism engaging member 802 is not able to pass through the forked end 890 of the pivoting member 880.

With respect to the indicators 780 and 782, indicator 780 is visible and generally indicates the tumbler 774 is locked and that a rod engaging member 800 is being held by the tumbler 774. When the lock state indicator 780 is not visible and the locking mechanism indicator 782 is visible, it is generally an indication that the rod engaging member 800 has been released. For insertion, and subsequent locking in place of a replacement rod engaging member 800, the curtain release mechanism must be armed, which entails turning the tumbler 774 back to the original position, with the lock state indicator 780 again visible. The locking mechanism indicator 782 is also visible at this time. When a replacement rod engaging member 800 is inserted into an armed curtain release mechanism 708, the release mechanism engaging member 802 engages the flexible latch 862, causing the pivoting member 880 to rotate somewhat, and lock in place. Upon completion of this step, locking mechanism indicator 782 is retracted back into the curtain release mechanism, and is no longer visible.

Figure 19:
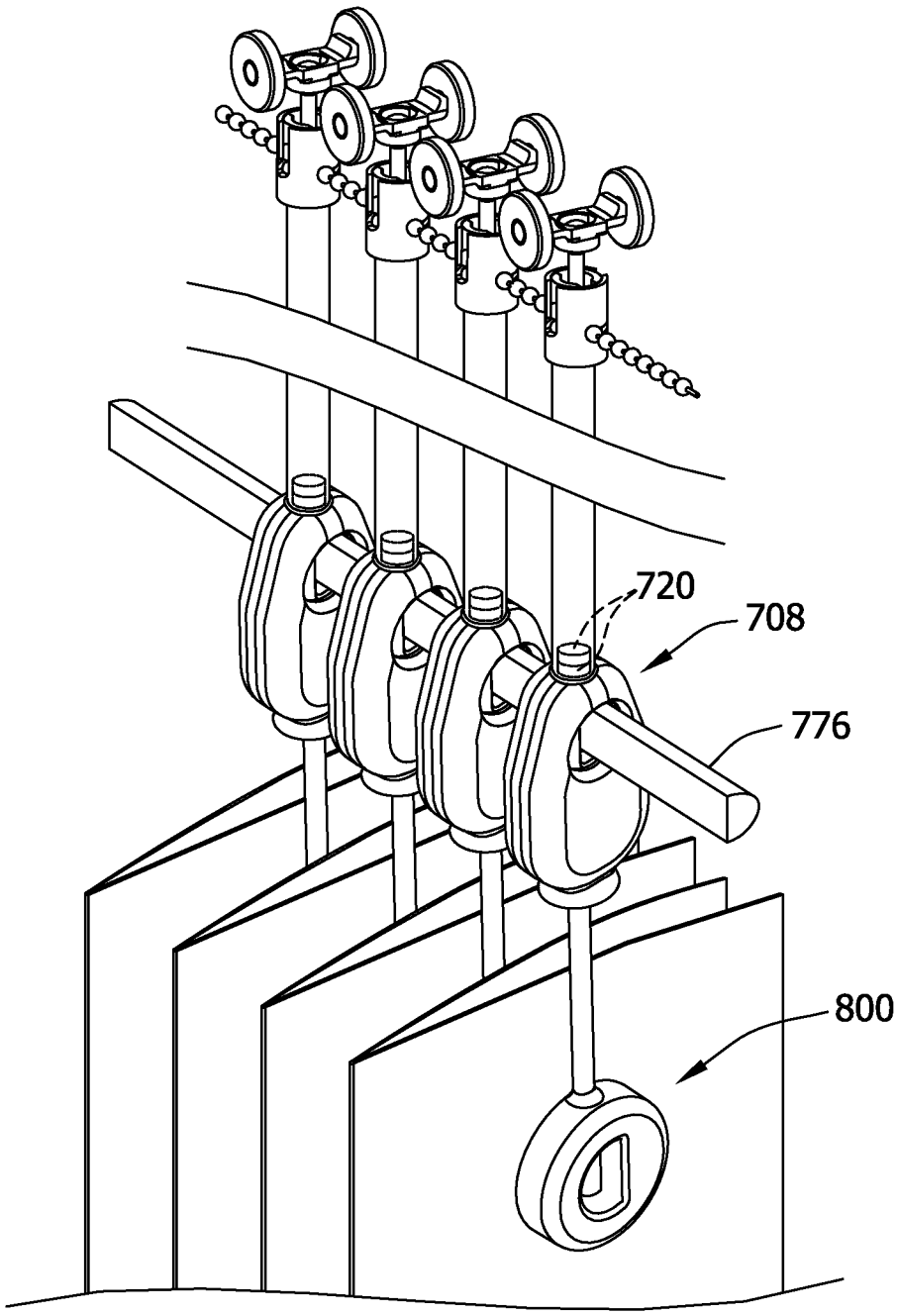
FIG. 19 is a perspective view of several curtain portions that each include a rod engaging member extending therefrom, the rod engaging members engaging respective curtain release mechanisms, a key extending through the curtain release mechanisms in preparation of releasing the rod engaging members therefrom.

FIG. 19 is a perspective view of several curtain portions that each include a rod engaging member 800 extending therefrom, the rod engaging members 800 engaging respective curtain release mechanisms 708, a key 776 extending through the curtain release mechanisms 708 in preparation of releasing the rod engaging members 800 therefrom.

Figure 20:
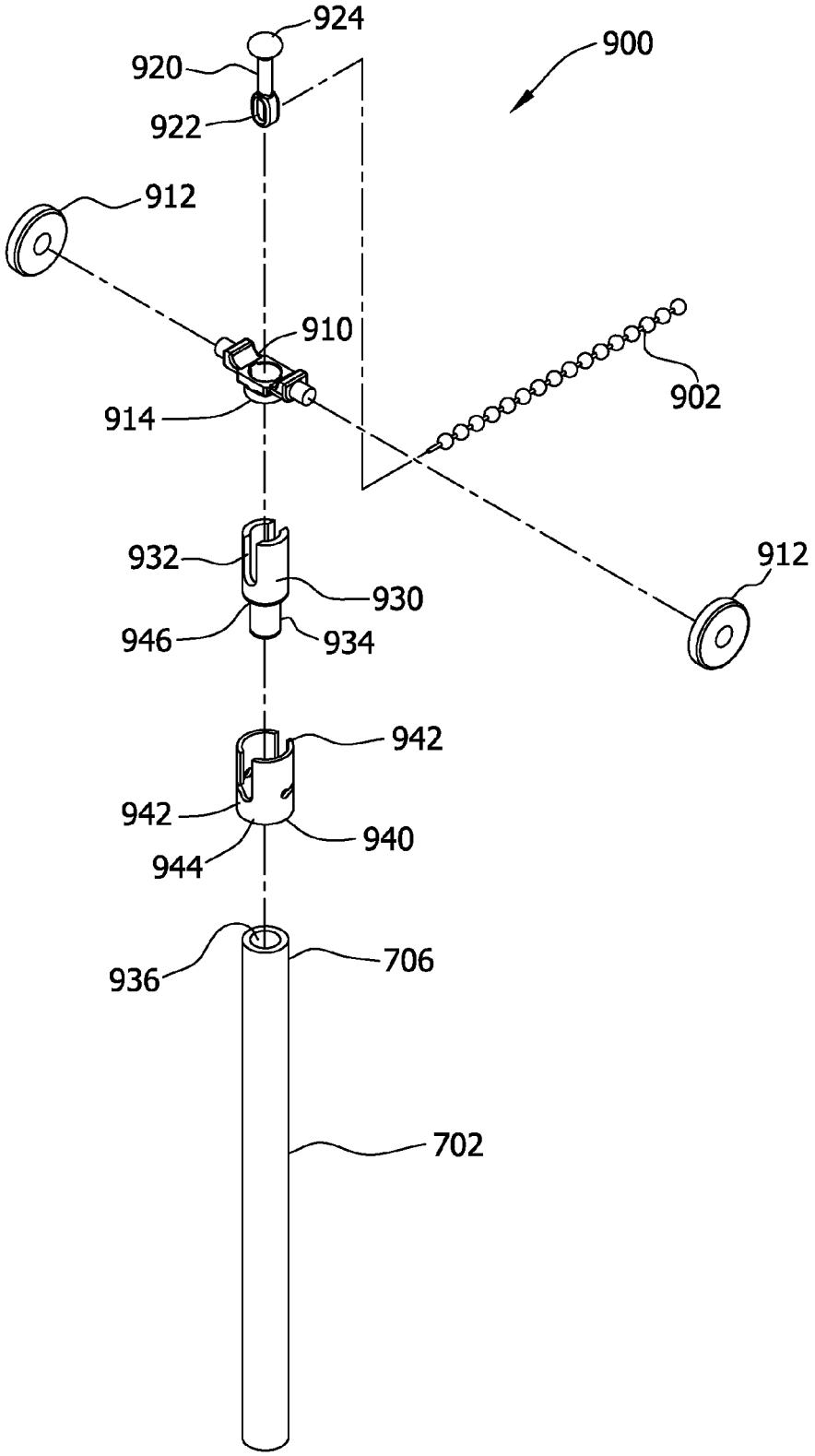
FIG. 20 is an exploded view of a ceiling track engaging component that incorporates a linkage.

FIG. 20 is an exploded view of an alternative embodiment of a ceiling track engaging component 900 which incorporates a linkage 902 that extends the width of the above described curtains. In one embodiment, ceiling track engaging component 900 and linkage 902 are configured to be utilized with, for example, ceiling track component 738 (shown in FIG. 15) and rods 702. More specifically, the linkage 902, as is easily understood, engages each of the rods 702 of a curtain system to restrain individual rod 702 movement with respective to the other rods 702 of the curtain system. Specifically, the linkage 902 operates to dictate a maximum spacing between upper ends 706 of adjacent rods 702. Dictating a maximum spacing between upper ends 706 of adjacent rods 702 has been found useful in the operation of such a curtain system, for example, in the pulling of the curtain around a curve in the ceiling track, such as may be found in a hospital room having multiple beds.

Ceiling track engaging component 900 includes a truck 910 to which wheels 912 are rotatably attached and spaced to engage a ceiling track as described above. The truck 910 includes a centrally located bore 914 through which a portion of a linkage engaging component 920 can be inserted. Specifically, the linkage engaging component 920 includes a linkage engaging opening 922 formed at a first end of the linkage engaging component 920 and an enlarged end 924 opposite the linkage engaging opening 922.

The linkage engaging opening 922 portion of the linkage engaging component 920 can be inserted through the bore 914 and the enlarged end 924 engages the truck. As illustrated, the linkage 902 passes through the opening 922. In one embodiment, the enlarged end 924 is oblong in shape thereby preventing reducing possible rotation of the rod 702 to substantially less than 180 degrees as the enlarged end 924 will engage a portion of the truck 910.

A series of sleeves are utilized in the illustrated embodiment of ceiling track engaging component 900 to attach the linkage 902 and linking engaging component 922 to the first end 706 of the rod 702. A first sleeve 930 has slots 932 formed therein such that the linkage 902 can extend therethrough as the linking engaging component 922 is inserted into the first sleeve 930. A stem 934 forms a portion of the first sleeve 930 and is sized to fit snugly within a bore 936 associated with the hollow rod 702.

A second sleeve 940 is configured for insertion of the first sleeve 930, the linkages 902 and the linking engaging component 922. The second sleeve 940 has two matching slots 942 which extend for a distance in a vertical direction, then for an additional distance in the horizontal direction. Slots 942 are essentially configured so that the linkage 902 can be slid down the vertical portion of the slots 942. The second sleeve 940 can then be rotated so that the linkage 902 is positioned within the horizontal portion of the slots 942. The effect is a locking of the linkage 902 in a particular position, and retention of the linkage within the first sleeve 930 and second sleeve 940 combination. A lip (not shown) may be formed at a bottom 944 of the second sleeve 940 which engages a ledge 946 which results from the narrowing of stem 934, Engagement between the lip and the ledge 946 operates to prevent the second sleeve 940 from being easily removed from the completed assembly.

The linkage 902 has been found to be helpful in other ways when incorporated across a plurality of rods such as rod 702. For example and in certain applications, the rods 702 may have a tendency to rotate, which has the potential for making alignment of the rods for the key driven curtain release described herein difficult. However, a user generally only has to provide a slight pull on the linkage to realign the rods 702 for the curtain removal and installation operation. Once the linkage is utilized to "realign" the rods 702, the magnets 720 (shown in FIGS. 14, 16 and 19) are of sufficient strength to maintain such alignment.

Figure 21:
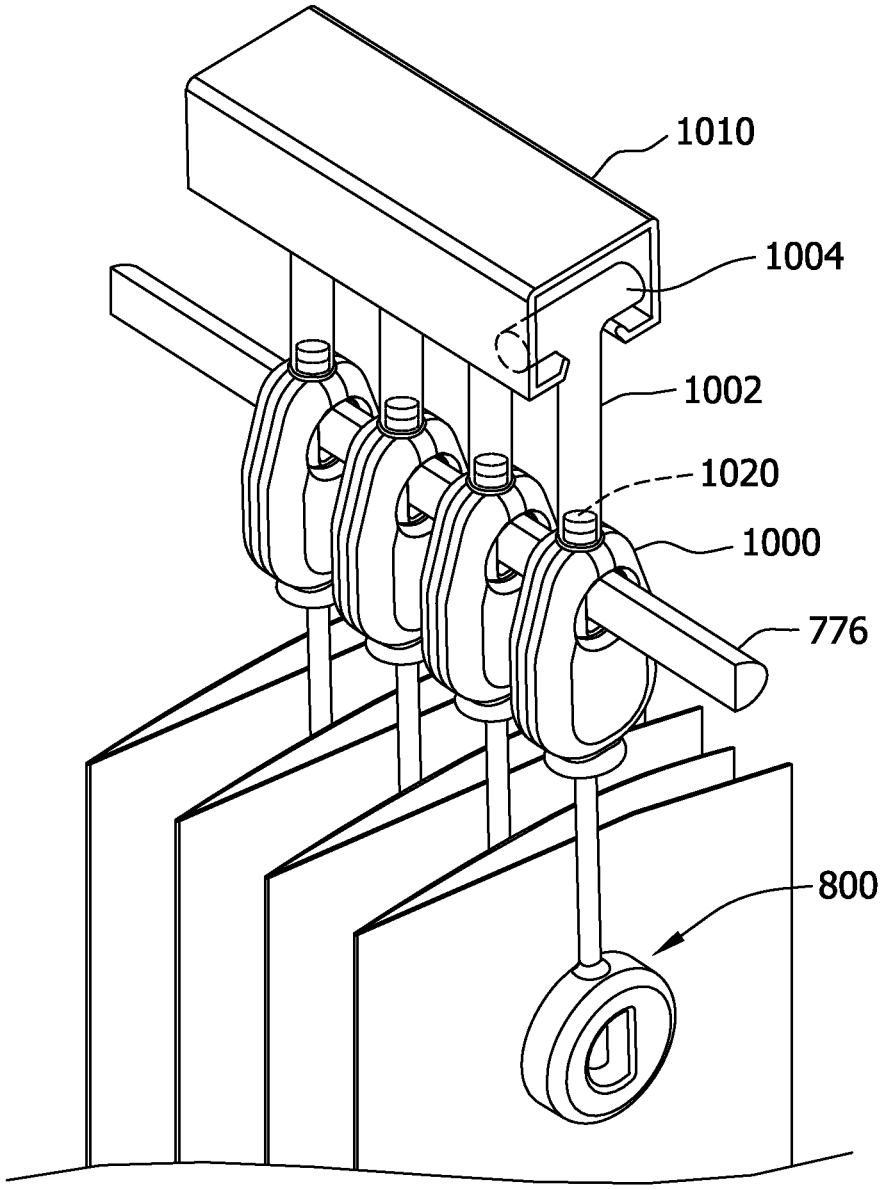
FIG. 21 is a diagram that illustrates an embodiment of a curtail release mechanism useful in locations with lower ceilings.

FIG. 21 is a diagram that illustrates an alternative embodiment of a curtain release mechanism 1000 which may be useful in locations with lower ceilings, or in locations where ventilation and fire safety requirements described above may not apply. In one practical example, the embodiment illustrated in FIG. 21 may be utilized in front of a closet or pantry.

The illustrated embodiment still provides an ability to replace curtains as described throughout this document, but does not incorporate the above described rods 702. Instead, the curtain release mechanisms 1000 each include a ceiling track engaging component 1002 extending directly therefrom. In the illustrated embodiment, the ceiling track engaging component 1002 is a "T" shaped component, the top 1004 of which is configured to extend across and slidably engage a ceiling track 1010. Embodiments that incorporate rollers as described above are also contemplated. One main difference between the embodiments described with respect to FIG. 20 and the embodiments which incorporate the rods 702 is length. As a non limiting example, the ceiling track engaging component 1002 is generally less than six inches in length while the above described rods 702 are generally in excess of twelve inches in length. Of course embodiments of each are contemplated that are outside of these general guidelines.

The ceiling track engaging component 1002 may also incorporate magnets 1020. With the exception of the length generally associated with the ceiling track engaging component 1002, operation of curtain release mechanism 1000 is otherwise identical to that of the above described curtain release mechanism 708 (shown in FIG. 18).

The above described embodiments address several of the known problems related to the installation and removal of curtains that are attached to a ceiling mechanism. In one aspect, the ease of removal and installation of the curtain is increased as compared to known products. In another aspect, the described operation with respect to installation and removal reduces the exposure of personnel to any contaminants that may be embedded within such curtains.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A curtain system comprising:

a plurality of rod engaging members configured to be attached to a curtain; and a plurality of curtain release mechanisms configured to suspend the plurality of rod engaging members and curtain therefrom, the curtain release mechanisms each having a tumbler comprising a key aperture, the tumblers for use in selectively coupling the rod engaging members to and releasing the rod engaging members from the curtain release mechanisms;

wherein the tumblers of the plurality of curtain release mechanisms are simultaneously rotatable between a first position for coupling the rod engaging members to the curtain release mechanisms and a second position for releasing the rod engaging members from the curtain release mechanisms by insertion of a key into the key apertures of the tumblers of the plurality of curtain release mechanisms and rotation of the key from a first key position to a second key position.

2. A curtain system according to claim 1 wherein the curtain release mechanisms each include a first body half and a second body half, and wherein the tumblers are generally positioned between the first body half and second body half.

3. A curtain system according to claim 2 wherein the curtain release mechanisms further include a flexible latch and a pivoting member operably coupled to the tumbler and positioned generally between the first body half and the second body half, wherein the flexible latch and the pivoting member are configured to secure the rod engaging member to the curtain release mechanism when the tumbler is in the first position, and wherein the flexible latch and the pivoting member are configured to release the rod engaging member from the curtain release mechanism when the tumbler is in the second position.

4. A curtain system according to claim 2 wherein the first body half and the second body half are configured for assembly utilizing a snap-fit configuration.

5. A curtain system according to claim 1 wherein the rod engaging members include a first curtain engaging piece and a second curtain engaging piece configured for snap fit engagement to thereby attach the rod engaging member to the curtain.

6. A curtain system according to claim 5 wherein the first curtain engaging piece and the second curtain engaging piece are configured with a keyway therethrough such that when snap fit together, the key may be inserted through the keyway.

7. A curtain system according to claim 1 further comprising a rod coupled to each curtain release mechanism at a first end portion of the rod, and wherein the rod comprises a ceiling track engaging component at an opposite second end portion thereof configured to couple the rod to a ceiling track for suspending the rod, the curtain release mechanism, the rod engaging member, and the curtain from the ceiling track.

8. A curtain system according to claim 7 wherein the ceiling track engaging component comprises:

a ceiling track engagement truck;

a roller rotatably attached to the ceiling track engagement truck;

a linkage engaging component configured for at least a limited rotatable engagement with the ceiling track engagement truck; and at least one sleeve operable to attach a linkage and the linkage engaging component to the second end portion of the rod.

9. A curtain system according to claim 8 wherein the at least one sleeve comprises:

a first sleeve comprising slots formed therein for engagement of the linkage, and a stem configured for engagement with a bore in the second end portion of the rod; and a second sleeve comprising two matching slots which extend for a distance in a vertical direction and for an additional distance in a horizontal direction for engagement of the linkage, the second sleeve being rotatable with respect to the first sleeve so that the linkage can be positioned within a portion of the slots of the second sleeve extending in the horizontal direction.

10. A curtain system according to claim 1 further comprising a rod coupled to each curtain release mechanism, and wherein the rod comprises at least one magnet disposed proximate to the curtain release mechanism.

11. A curtain system according to claim 1, wherein each curtain release mechanism includes a pivoting member having a forked end portion configured to couple the rod engaging members to the curtain release mechanisms when the tumbler of the curtain release mechanisms are the first position.

12. A curtain system according to claim 6, further comprising the key configured to be inserted through the keyway of the first and second curtain engaging pieces.

13. A curtain system comprising:

a curtain body;

a plurality of rod engaging members directly attached to the curtain body, the rod engaging members also configured to be coupled to curtain release mechanisms for suspending the curtain body from the curtain release mechanisms, the rod engaging members each defining a keyway therethrough; and an elongate key configured to be inserted through the keyway of each of the plurality of rod engaging members when the curtain body is attached to the rod engaging members such that each of the plurality of rod engaging members can be located together on the key for supporting the rod engaging members when coupling the rod engaging members to the curtain release mechanisms wherein the elongate key is not affixed to the curtain body.

14. A curtain system according to claim 6, further comprising a key configured to release the rod engaging members from the plurality of curtain release mechanisms after the rod engaging members are coupled to the curtain release mechanisms.

15. A curtain system according to claim 13, further comprising the curtain release mechanisms.

16. A curtain system according to claim 13, wherein each of the rod engaging members includes a curtain engaging piece configured to attach the corresponding rod engaging member to the curtain body, and wherein the keyway of each of the rod engaging members is defined in the corresponding curtain engaging piece of each of the rod engaging members.

17. A curtain system according to claim 13, wherein each of the rod engaging members includes a ball-shaped end portion configured to couple the corresponding rod engaging member to one of the curtain release mechanisms.

18. A curtain system for suspending a curtain, the curtain system comprising:

a plurality of rods; and curtain release mechanisms coupled to end portions of the rods, each of the curtain release mechanisms comprising a user operable mechanism configured for retention of and subsequent release of a curtain to and from the corresponding curtain release mechanism;

wherein the user operable mechanism of each of the curtain release mechanisms is operable between a first position for coupling the curtain to the corresponding curtain release mechanism and a second position for releasing the curtain from the corresponding curtain release mechanism; and wherein the user operable mechanism of each of the curtain release mechanisms defines a keyway, and wherein the curtain release mechanisms can be positioned to receive a key through the keyway of each of the curtain release mechanisms such that the user operable mechanisms of the curtain release mechanisms can be operated together by the key from the first position to the second position.

19. A curtain system according to claim 18 further comprising ceiling track engaging components coupled to end portions of the rods opposite the curtain release mechanisms, and wherein each of the ceiling track engaging components includes at least two rollers configured to engage a ceiling mounted track component.

20. A curtain system according to claim 18 further comprising rod engaging members configured to be attached to the curtain for use in suspending the curtain from the curtain release mechanisms, each of the rod engaging members comprising a curtain engaging piece configured to attach the corresponding rod engaging member to the curtain, and wherein the curtain engaging piece of each of the rod engaging members defines a keyway for receiving a key through the corresponding rod engaging member such that each of the rod engaging members can be supported together on the key.

21. A curtain system according to claim 20 wherein the curtain engaging piece is a first curtain engaging piece, and wherein each of the rod engaging members further comprises a second curtain engaging piece configured to press fit together with the corresponding first curtain engaging piece to thereby attach the corresponding rod engaging member to the curtain.

22. A curtain system according to claim 18 wherein each of the rods comprises at least one magnet disposed proximate to the corresponding curtain release mechanism coupled to the rod.

23. A curtain system according to claim 18, further comprising the key configured to be positioned through the keyway of each of the curtain release mechanisms.

24. A curtain system according to claim 18, further comprising rod engaging members configured to be attached to the curtain for use in suspending the curtain from the curtain release mechanisms, and wherein each of the rod engaging members defines a keyway configured to receive a key such that each of the rod engaging members can be supported together on the key.

25. A curtain system according to claim 24, wherein each of the rod engaging members includes at least one curtain engaging piece for attaching the curtain to the corresponding rod engaging member, and wherein the keyway of each of the rod engaging members is defined in the corresponding at least one curtain engaging piece of each of the rod engaging members.

26. A curtain system according to claim 24, further comprising the key configured to be received by the keyway of each of the rod engaging members.

27. A curtain release mechanisms according to claim 18, further comprising rod engaging members configured to be coupled to the curtain release mechanisms for use in suspending the curtain body from the curtain release mechanisms.

28. A curtain system according to claim 11, wherein each rod engaging member includes a round end portion, and wherein the forked end portion of the pivoting member of the curtain release mechanisms is configured to mate with the round end portion of the rod engaging members to thereby couple the rod engaging members to the curtain release mechanisms.

* * * * *